US008979537B2

(12) United States Patent
Stone

(10) Patent No.: US 8,979,537 B2
(45) Date of Patent: Mar. 17, 2015

(54) FIREARM BARREL PLUG AND TRAINING METHOD

(76) Inventor: Richard Scott Stone, Plano, TX (US)

( * ) Notice: Subject to any disclaimer, the term of this patent is extended or adjusted under 35 U.S.C. 154(b) by 0 days.

(21) Appl. No.: 13/397,667

(22) Filed: Feb. 15, 2012

(65) Prior Publication Data

US 2012/0214136 A1 Aug. 23, 2012

Related U.S. Application Data

(60) Provisional application No. 61/442,877, filed on Feb. 15, 2011, provisional application No. 61/454,668, filed on Mar. 21, 2011.

(51) Int. Cl.
*F41G 3/26* (2006.01)
*F41A 17/44* (2006.01)

(52) U.S. Cl.
CPC ..... *F41A 17/44* (2013.01); *F41G 3/2655* (2013.01)
USPC ..... 434/21; 434/19

(58) Field of Classification Search
USPC ..... 434/11–27; 42/70.01–70.11
See application file for complete search history.

(56) References Cited

U.S. PATENT DOCUMENTS

| | | | | |
|---|---|---|---|---|
| 4,465,464 | A * | 8/1984 | Schoenberg | 434/12 |
| 5,344,320 | A * | 9/1994 | Inbar et al. | 434/22 |
| 6,579,098 | B2 * | 6/2003 | Shechter | 434/21 |
| 6,796,072 | B2 * | 9/2004 | Barber et al. | 42/70.11 |
| 6,966,775 | B1 * | 11/2005 | Kendir et al. | 434/19 |
| 7,959,314 | B1 * | 6/2011 | Rodriguez | 362/103 |
| 2011/0281243 | A1 * | 11/2011 | Uhr | 434/16 |

* cited by examiner

*Primary Examiner* — Timothy A Musselman
(74) *Attorney, Agent, or Firm* — Thomas J. Osborne, Jr., PC; Thomas J. Osborne, Jr.

(57) ABSTRACT

A training/safety plug for use in firearms is provided. In one implementation, the plug comprises a chamber end and a shaft extending away from the chamber end. The chamber end is adapted to fit within a chamber of a designated firearm, the chamber end has a cross-sectional dimension sufficient to prevent the chamber end from extending into a barrel of the designated firearm and further comprises a strike surface for receiving an impact of a firing pin and a proximal end dimension such that the chamber end is not engaged by an ejector mechanism of the firearm. The shaft comprises a barrel end coupled to and extending distally from the generally cylindrical chamber end. The training/safety plug renders the designated firearm inert. Methods of training a student to target a firearm or other targeting device are also disclosed.

16 Claims, 11 Drawing Sheets

NOTES:
1) ALL ANGLES TO BE 45° UNLESS NOTED OTHERWISE
2) ALL MEASUREMENTS IN INCHES
3) TOLERANCES FOR ALL MEASUREMENTS 0.002±

| CALIBER | A | B | C | D | E |
|---|---|---|---|---|---|
| 25 ACP | | | | 0.68 | 6.00 |
| 32 ACP | | | | 0.68 | 6.00 |
| 380 ACP | 0.37 | 0.334 | 0.12 | 0.68 | 6.00 |
| 9 MM | 0.39 | 0.334 | 0.12 | 0.75 | 6.00 |
| 357 SIG | 0.42 | 0.334 | 0.14 | 0.64 | 6.00 |
| 40 S&W | 0.42 | 0.384 | 0.14 | 0.85 | 6.00 |
| 45 ACP | 0.47 | 0.434 | 0.16 | 0.89 | 6.00 |
| 10 MM | 0.42 | 0.384 | 0.14 | 0.99 | 6.00 |

NOTES:
1) ALL ANGLES TO BE 45° UNLESS NOTED OTHERWISE
2) ALL MEASUREMENTS IN INCHES
3) TOLERANCES FOR ALL MEASUREMENTS 0.002±

| CALIBER | A | B | C | D | E |
|---|---|---|---|---|---|
| 25 ACP | | | | 0.68 | 6.00 |
| 32 ACP | | | | 0.68 | 6.00 |
| 380 ACP | 0.37 | 0.334 | 0.12 | 0.68 | 6.00 |
| 9 MM | 0.39 | 0.334 | 0.12 | 0.75 | 6.00 |
| 357 SIG | 0.42 | 0.334 | 0.14 | 0.64 | 6.00 |
| 40 S&W | 0.42 | 0.384 | 0.14 | 0.85 | 6.00 |
| 45 ACP | 0.47 | 0.434 | 0.16 | 0.89 | 6.00 |
| 10 MM | 0.42 | 0.384 | 0.14 | 0.99 | 6.00 |

NOTES:
1) ALL ANGLES TO BE 45° UNLESS NOTED OTHERWISE
2) ALL MEASUREMENTS IN INCHES
3) TOLERANCES FOR ALL MEASUREMENTS 0.002±

| CALIBER | A | B | C | D | E |
|---|---|---|---|---|---|
| 25 ACP | | | | 0.68 | 6.00 |
| 32 ACP | | | | 0.68 | 6.00 |
| 380 ACP | 0.37 | 0.334 | 0.12 | 0.68 | 6.00 |
| 9 MM | 0.39 | 0.334 | 0.12 | 0.75 | 6.00 |
| 357 SIG | 0.42 | 0.334 | 0.14 | 0.64 | 6.00 |
| 40 S&W | 0.42 | 0.384 | 0.14 | 0.85 | 6.00 |
| 45 ACP | 0.47 | 0.434 | 0.16 | 0.89 | 6.00 |
| 10 MM | 0.42 | 0.384 | 0.14 | 0.99 | 6.00 |

NOTES:
1) ALL MEASUREMENTS IN INCHES
2) TOLERANCES FOR ALL MEASUREMENTS 0.002±

| CALIBER | A | B | C | D | J |
|---|---|---|---|---|---|
| 223 | 0.376 | 0.220 | 0.2 | 1.438 | 6.00 |
| .308 WIN | 0.470 | 0.300 | 0.151 | 1.559 | 6.00 |

NOTES:
1) ALL MEASUREMENTS IN INCHES
2) TOLERANCES FOR ALL MEASUREMENTS 0.002±

| CALIBER | A | B | C | D | E | G | H | J |
|---|---|---|---|---|---|---|---|---|
| 25 ACP | 0.272 | 0.237 | 0.107 | 0.610 | X | X | X | 6.00 |
| 32 ACP | 0.333 | 0.320 | 0.100 | 0.667 | 5.5 | .125 | .205 | 6.00 |
| 380 ACP | 0.372 | 0.336 | 0.120 | 0.680 | 5.5 | .125 | .205 | 6.00 |
| 9 MM | 0.388 | 0.336 | 0.120 | 0.750 | 5.5 | .125 | .205 | 6.00 |
| 357 SIG | 0.420 | 0.336 | 0.140 | 0.640 | 5.5 | .125 | .205 | 6.00 |
| 40 S&W | 0.418 | 0.386 | 0.140 | 0.850 | 5.5 | .1 | .275 | 6.00 |
| 45 ACP | 0.468 | 0.432 | 0.160 | 0.890 | 5.5 | .1 | .275 | 6.00 |
| 10 MM | 0.418 | 0.386 | 0.140 | 0.990 | 5.5 | .1 | .275 | 6.00 |

NOTES:
1) ALL MEASUREMENTS IN INCHES
2) TOLERANCES FOR ALL MEASUREMENTS 0.002±

| CALIBER | A | B | D | E |
|---|---|---|---|---|
| 25 ACP | | | 0.68 | 6.00 |
| 32 ACP | | | 0.68 | 6.00 |
| 380 ACP | 0.37 | 0.334 | 0.68 | 6.00 |
| 9 MM | 0.39 | 0.334 | 0.75 | 6.00 |
| 357 SIG | 0.42 | 0.334 | 0.64 | 6.00 |
| 40 S&W | 0.42 | 0.384 | 0.85 | 6.00 |
| 45 ACP | 0.47 | 0.434 | 0.89 | 6.00 |
| 10 MM | 0.42 | 0.384 | 0.99 | 6.00 |

NOTES:
1) ALL ANGLES TO BE 45° UNLESS NOTED OTHERWISE
2) ALL MEASUREMENTS IN INCHES
3) TOLERANCES FOR ALL MEASUREMENTS 0.002±

| CALIBER | A | B | C | D | E |
|---|---|---|---|---|---|
| 25 ACP | | | | 0.68 | 6.00 |
| 32 ACP | | | | 0.68 | 6.00 |
| 380 ACP | 0.37 | 0.334 | 0.12 | 0.68 | 6.00 |
| 9 MM | 0.39 | 0.334 | 0.12 | 0.75 | 6.00 |
| 357 SIG | 0.42 | 0.334 | 0.14 | 0.64 | 6.00 |
| 40 S&W | 0.42 | 0.384 | 0.14 | 0.85 | 6.00 |
| 45 ACP | 0.47 | 0.434 | 0.16 | 0.89 | 6.00 |
| 10 MM | 0.42 | 0.384 | 0.14 | 0.99 | 6.00 |

NOTES:
1) ALL MEASUREMENTS IN INCHES
2) TOLERANCES FOR ALL MEASUREMENTS 0.002±

| CALIBER | G | H |
|---|---|---|
| 380 ACP | 0.5 | 0.342 |
| 9 MM | 0.5 | 0.342 |
| 357 SIG | 0.5 | 0.342 |
| 40 S&W | 0.5625 | 0.392 |
| 45 ACP | 0.5625 | 0.442 |
| 10 MM | 0.5625 | 0.392 |

FIREARM BARREL PLUG AND TRAINING METHOD

CROSS-REFERENCE TO RELATED APPLICATIONS

This application claims the benefit of U.S. provisional application No. 61/442,877, filed 15 Feb. 2011 entitled "Barrel Training/Safety Plug for use in Marketing and for use in Training" and U.S. provisional application No. 61/454,668, filed 21 Mar. 2011 entitled "Reflexive Conditioned Targeting Method for Use in Teaching Hand Gun Use", both of which are hereby incorporated by reference as though fully set forth herein.

BACKGROUND a. Field

The instant invention relates to safety and training plug for a firearm and a method of training with a firearm.

b. Background

There are many kinds of safety devices provided for pistols. Although various trigger locks, barrel locks, and magazine locks are designed to render a weapon safe, these fall into one of several categories. 1) Chamber indicators or flags, devices inserted into the chamber with some sort of protruding member indicating its presence. 2) Locking devices inserted through the distal end of the barrel actuated with either a tumbler lock or a unique pattern tool to remove the device. 3) Trigger locks, attached to the trigger housing and placing some sort of mechanical block behind the trigger preventing it from being pressed. 4) Encasement apparatus's that enclose the operational features of a firearm and lock using some sort of mechanism. 5) Magazine well locks, cable locks inserted through the barrel and out the ejection port, or through the mag well and out the ejection port. 6) Electronic identification devices that recognize some unique aspect of the authorized users person and electronically enable or disable the gun. 7) Locking devices and mechanisms built into the weapons system of operation from the inception of design, and included as a function of original manufacture.

BRIEF SUMMARY

A training/safety plug for use in firearms is provided. In one implementation, the plug comprises a chamber end and a shaft extending away from the chamber end. The chamber end is adapted to fit within a chamber of a designated firearm, the chamber end has a cross-sectional dimension sufficient to prevent the chamber end from extending into a barrel of the designated firearm and further comprises a strike surface for receiving an impact of a firing pin of the designated firearm and a proximal end dimension such that the chamber end is not engaged by an ejector mechanism of the firearm. The shaft comprises a barrel end coupled to and extending distally from the generally cylindrical chamber end; the barrel end of the generally cylindrical shaft further adapted to extend from the chamber end into the barrel of the designated firearm. The training/safety plug renders the designated firearm inert when the chamber end is disposed in a chamber of the firearm and the barrel end extends into the barrel of the firearm.

Methods of training a student to target a firearm or other targeting device are also disclosed. In one implementation, for example, a process to teach targeting a firearm or other targeting device is provided. The method comprises: instructing a student to aim a targeting device at a target; activating a laser to illuminate a projected impact location of a projectile shot from the targeting device as targeted by the student; and instructing the student to re-target the targeting device to illuminate the target via the activated laser, wherein the re-targeting process provides a feedback loop to the student for correcting the student's targeting skills.

In another implementation, a process of training to target a targeting device is provided. In this implementation, the process comprises: aiming a targeting device at a target; activating a laser to illuminate a projected impact location of a projectile shot from the targeting device as targeted by the student; and re-targeting the targeting device to illuminate the target via the activated laser, wherein the re-targeting process provides a feedback loop to the student for correcting the student's targeting skills.

The foregoing and other aspects, features, details, utilities, and advantages of the present invention will be apparent from reading the following description and claims, and from reviewing the accompanying drawings.

Although various drawings may include dimensions, angles or other notations, these are merely exemplary and are not required or limiting in any way.

DETAILED DESCRIPTION

In nearly all of the previous safety systems, the lock mechanism can be overcome in numerous ways. Once overcome the weapon becomes immediately usable. With a Barrel Training/Safety Plug ("Plug") as described herein, even after a lock was cut off or the protruding end of the plug cut, some implementations of the Plug still require the weapon to be disassembled to be operable for live firing. In a training or retail setting a person bent on doing harm could be restrained before the disassembly, removal of the Plug and the reassembly of the weapon could be completed. Such is useful, for example, in connection with a retail setting for the sale of pistols. With the Plug inserted in each weapon, a person could not disassemble the weapon, remove the Plug and reassemble the weapon, in order to chamber a round before being subdued. Indeed, safety devices currently on the market, can, as a rule, be quickly removed to get the gun into action, and cite this feature as a design benefit. In some implementations of a Plug, the Plug can provide exactly the opposite goal and effect. In these implementations, the Plug cannot be quickly removed so that the weapon can be gotten into action. This feature gives it a specific use in the training or in the retail sales market.

Figure 1:
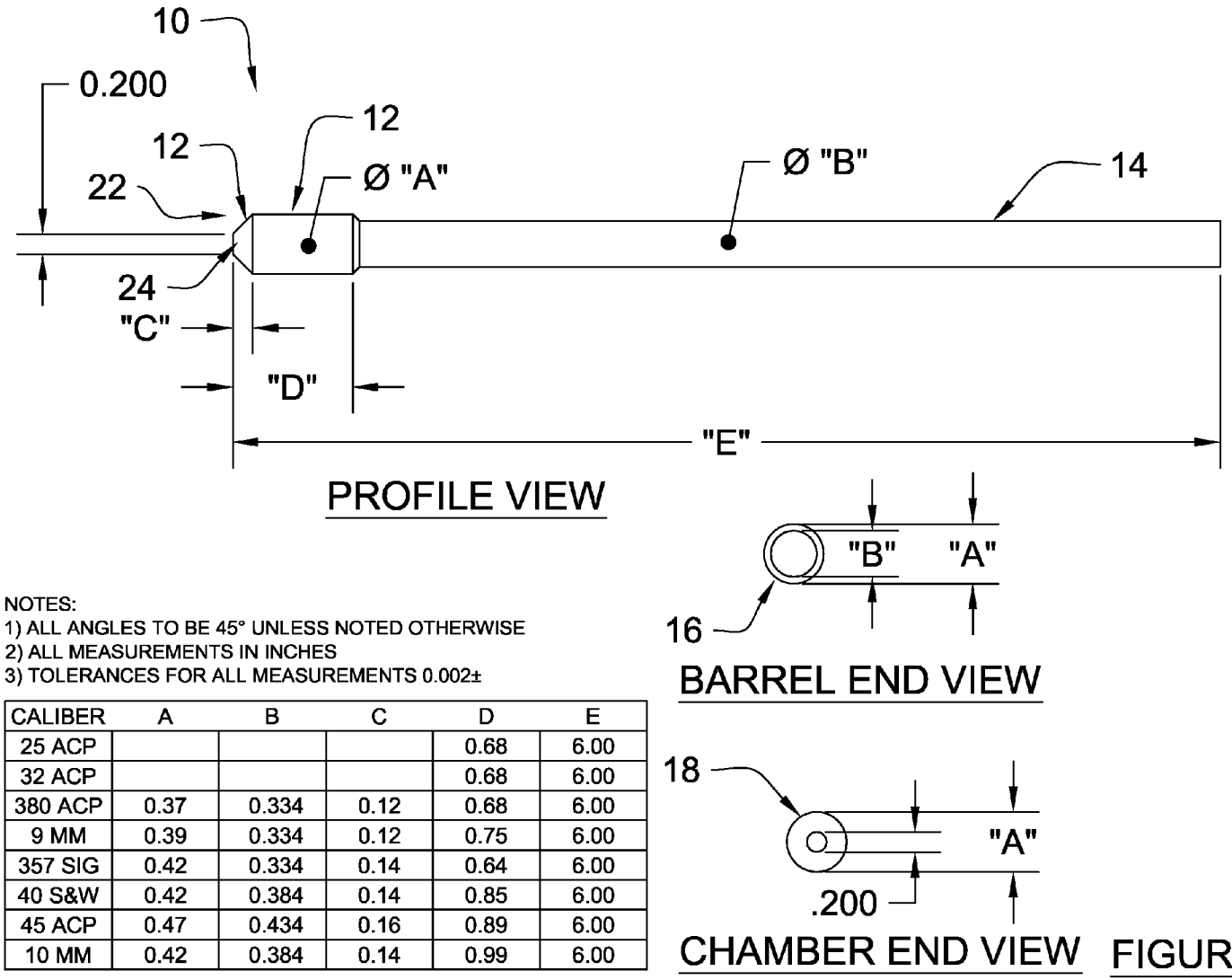
FIG. 1 shows side and end views of an example implementation of a Barrel Training/Safety Plug.

FIG. 1 shows an example implementation of a Barrel Training/Safety Plug ("Plug") 10. The Plug 10 may comprise a single piece or multi-piece device. In the implementation shown in FIG. 1, for example, the Plug 10 comprises a single piece device formed into a generally cylindrical shape. In this implementation, the Plug 10 comprises a generally cylindrical chamber end 12 and a generally cylindrical barrel end 14 or shaft that extends into a barrel of a firearm, such as, but not limited to, a pistol, rifle, or shotgun. Although certain embodiments are described herein for convenience with reference to a particular type of firearm, such as a pistol, embodiments may also be designed for and/or used in conjunction with other types of firearms. One or more pieces or regions of the Plug 10 can be turned on a lathe or injection molded and is formed of plastic, hard rubber, other synthetic material, or metal (e.g., aluminum, brass, steel, stainless steel, etc.). The material may be coated or uncoated. A Plug formed of a metal such as stainless steel, for example, may be coated (e.g., with Teflon® or another coating) to prevent damage to the inside of a firearm barrel. It should be noted that while FIG. 1 depicts a single piece, a multi-piece unit that may be assembled into a form substantially similar to that shown in FIG. 1 is also possible in accordance with other embodiments of the present invention. In addition, other methods of construction may be used to construct a Plug 10.

The Plug 10 is inserted into the chamber and barrel of a firearm. The Plug 10 has various uses, but finds particular applicability to use in semi-automatic and automatic pistols and certain other semi-automatic weapon systems. Once inserted, the chamber end 12 of the Plug 10 (also marked "A" in FIG. 1) resides in the firing chamber of a firearm. The shaft 14 (also labeled "B") extends into the barrel of the weapon. In one implementation, for example, the shaft 14 runs through the length of the barrel and extends out of the weapon. In this implementation, the shaft 14 may be visible extending from the barrel of the firearm and indicate that the weapon has been disabled. Further, in some cases, installation of the Plug 10 into a weapon requires disassembly of the weapon.

Various measurements are noted on FIG. 1 corresponding to various calibers; however, these measurements are merely exemplary and the Plug 10 can be made to fit other calibers as well. Based upon the disclosure provided herein, one of ordinary skill in the art will recognize a variety of appropriate dimensions that may be used depending upon the particular application. Looked at from the barrel end view 16 or chamber end view 18 of the Plug 10 shown in FIG. 1, it is clear that the Plug 10 is round in this implementation, although other shapes are possible. On the chamber end 12 of the Plug 10, which in this implementation generally resembles a cartridge of whatever caliber weapon the Plug 10 is intended to match. However, the Plug 10 cannot be engaged by an extractor of a pistol because the Plug 10 lacks a lip present on a typical shell casing. Rather, the Plug 10 in this implementation comprises a bevel 20 disposed (e.g., cut) at a base 22 of the chamber end 12 (part "A") of the Plug 10, as shown in FIG. 1. In this implementation, the bevel 20 allows for the casing extractor in the pistol to not engage and extract the Plug 10 from a chamber of a pistol.

In the particular implementation shown in FIG. 1, at the proximal end (chamber base end 22) of the Plug 10, a surface 24 disposed within the bevel 20 of the chamber end 12 provides a surface allowing for dry-firing of weapon without any damage or only minimal damage to the firing pin due to its direct impingement against the breach face of the slide. In the case where the chamber end 12 of the Plug 10 is of greater diameter than the barrel, the Plug 10 cannot be inserted or removed through the distal end of the barrel. In such a case, the weapon could need to be disassembled to clearly expose the chamber end of the barrel for a sufficient distance to allow for the insertion or removal of the Plug 10.

The material from which the Plug is made may be solid exhibiting only limited flexibility, though in some implementations it has some degree of elasticity.

Figure 2:
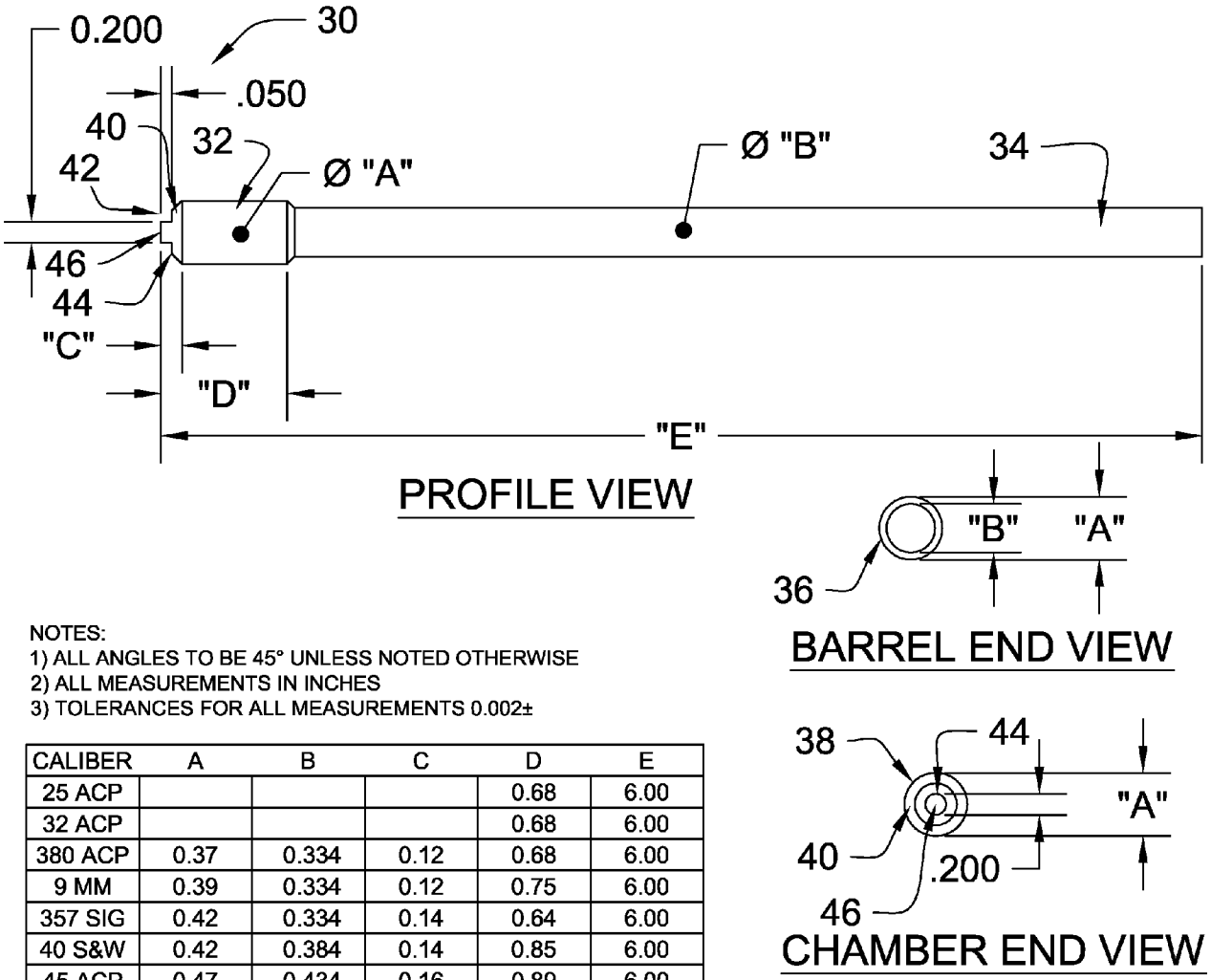
FIG. 2 shows side and end views of another example implementation of a Barrel Training/Safety Plug.
Figure 3:
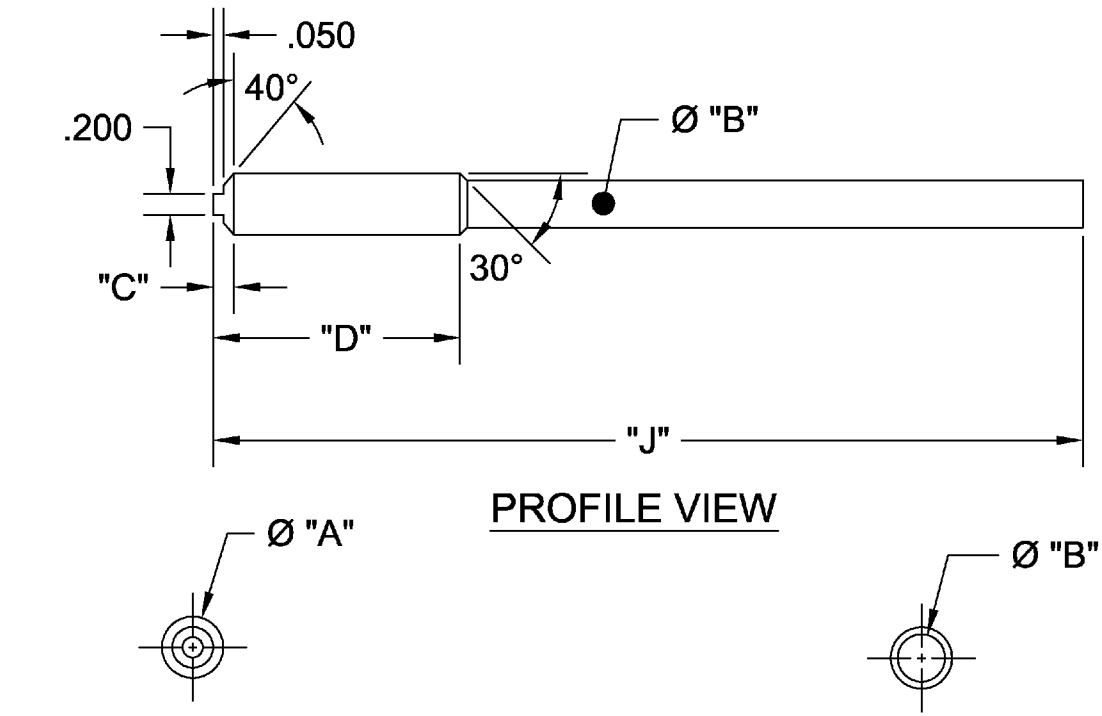
FIG. 3 shows side and end views of yet another example implementation of a Barrel Training/Safety Plug.

FIG. 2 shows another example implementation of a Barrel Training/Safety Plug ("Plug") 30. As described above with respect to FIG. 1, the Plug 30 may comprise a single piece or multi-piece device. In the implementation shown in FIG. 2, for example, the Plug 30 comprises a single piece device formed into a generally cylindrical shape. In this implementation, the Plug 30 comprises a generally cylindrical chamber end 32 and a generally cylindrical barrel end 34 or shaft that extends into a barrel of a firearm, such as, but not limited to, a pistol, rifle, or shotgun. One or more pieces or regions of the Plug 30 can be turned on a lathe or injection molded and is formed of plastic, hard rubber, other synthetic material, or soft metal, which may then be coated (e.g., with Teflon). It should be noted that while FIG. 3 depicts a single piece, a multi-piece unit that may be assembled into a form substantially similar to that shown in FIG. 2 is also possible in accordance with other embodiments of the present invention. In addition, other methods of construction may be used to construct a Plug 30.

The Plug 30 is inserted into the chamber and barrel of a firearm. The Plug 30 has various uses, but finds particular applicability to use in semi-automatic and automatic pistols and certain other semi-automatic weapon systems. Once inserted, the chamber end 32 of the Plug 30 (also marked "A" in FIG. 2) resides in the firing chamber of a firearm. The shaft 34 (also labeled "B") extends into the barrel of the weapon. In one implementation, for example, the shaft 34 runs through the length of the barrel and extends out of the weapon. In this implementation, the shaft 34 may be visible extending from the barrel of the firearm and indicate that the weapon has been disabled. Further, in some cases, installation of the Plug 30 into a weapon requires disassembly of the weapon.

Various measurements are noted on FIG. 2 corresponding to various calibers; however, these measurements are merely exemplary and the Plug 30 can be made to fit other calibers as well. Based upon the disclosure provided herein, one of ordinary skill in the art will recognize a variety of appropriate dimensions that may be used depending upon the particular application. Looked at from the barrel end view 36 or chamber end view 38 of the Plug 30 shown in FIG. 2, it is clear that the Plug 30 is round in this implementation, although other shapes are possible. On the chamber end 32 of the Plug 30, which in this implementation generally resembles a cartridge of whatever caliber weapon the Plug 30 is intended to match, the Plug 30 cannot be engaged by an extractor of a pistol because the Plug 30 lacks a lip present on a typical shell casing. Rather, the Plug 30 in this implementation comprises a bevel 40 disposed (e.g., cut) at a base 42 of the chamber end 42 (part "A") of the Plug 30, as shown in FIG. 2. The bevel 40 allows for the casing extractor in the pistol to pass by the Plug and not engage and extract the Plug 30 from a chamber of a pistol.

In the particular implementation shown in FIG. 2, at the proximal end (chamber base end 42) of the Plug 30, a round nipple 46 extends from surface 44 of the chamber end 32 and resembles the diameter of a primer on a live round. In some implementations, for example, the diameter of the nipple 46 may be about the same or larger than the diameter of a primer of a live round. The bevel 40 cut and the nipple 46 serve to prevent the Plug 30 from being extracted from the chamber and allow the Plug 30 to simulate a non-extracted shell casing (the nipple 46 acting as a standoff preventing contact with the extractor). The nipple 46 and the area immediately around it provide a flat surface 44 which serves as an impingement or resting point for an ejector to contact the Plug 30 when it reaches its rear most point of motion, providing an end point for cycle function. Additionally, the nipple 46 and the area surrounding it may allow for dry-firing of the weapon without any damage or only minimal damage to the firing pin due to its direct impingement against the breach face of the slide. In the case where the chamber end 32 of the Plug 30 is of greater diameter than the barrel, the Plug cannot be inserted or removed through the distal end of the barrel. In such a case, the weapon could need to be disassembled to clearly expose the chamber end of the barrel for a sufficient distance to allow for the insertion or removal of the plug 30.

FIG. 3 shows yet another implementation of a Barrel Training/Safety Plug ("Plug") 50 for a rifle. In this implementation, dimensions of the chamber end and barrel end differ so as to fit into a chamber and barrel of a rifle instead of a pistol.

Figure 4:
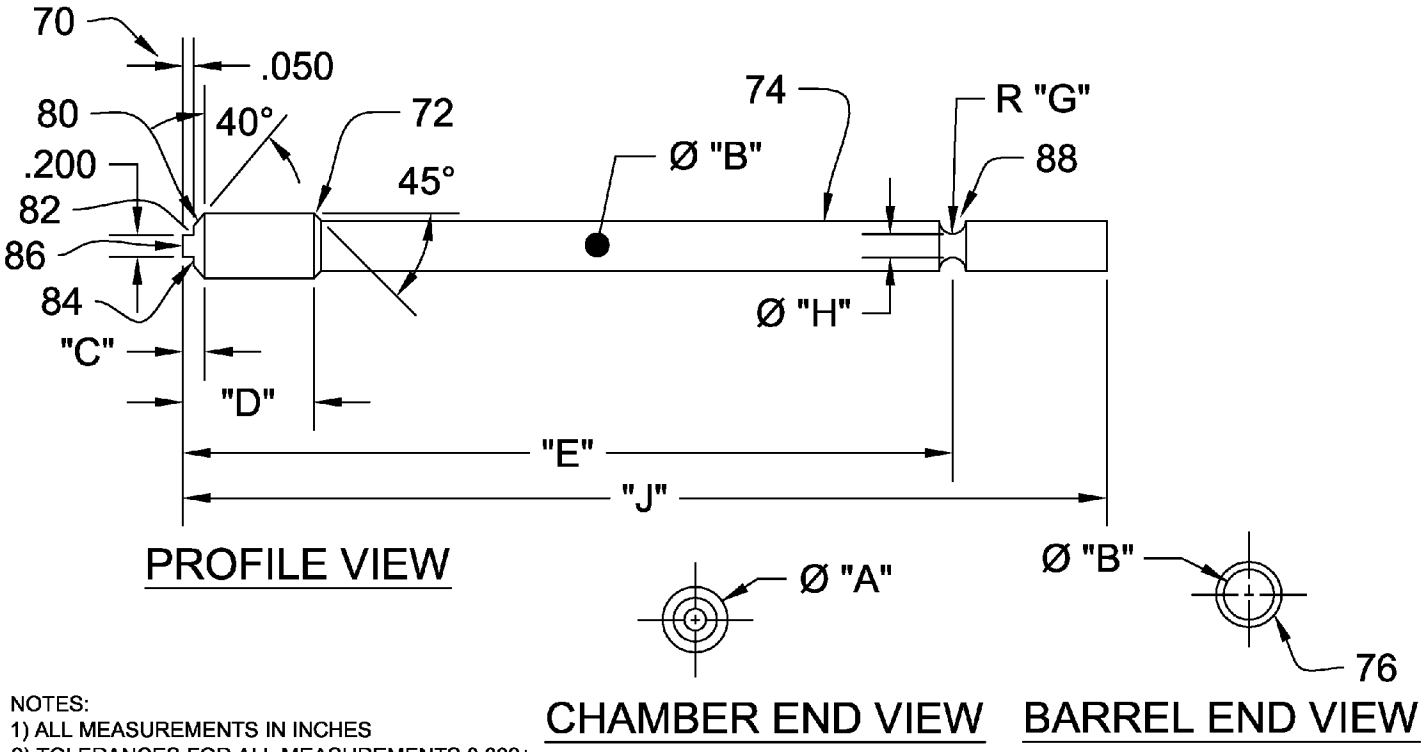
FIG. 4 shows side and end views of another example implementation of a Barrel Training/Safety Plug.

FIG. 4 shows another implementation of a Barrel Training/Safety Plug ("Plug") 70. As described above with respect to FIGS. 1 through 3, the Plug 70 may comprise a single piece or multi-piece device. In the implementation shown in FIG. 4, for example, the Plug 70 comprises a single piece device formed into a generally cylindrical shape. In this implementation, the Plug 70 comprises a generally cylindrical chamber end 72 and a generally cylindrical barrel end 74 or shaft that extends into a barrel of a firearm, such as, but not limited to, a pistol, rifle, or shotgun. One or more pieces or regions of the Plug 70 can be turned on a lathe or injection molded and is formed of plastic, hard rubber, other synthetic material, or soft metal, which may then coated with Teflon. It should be noted that while FIG. 4 depicts a single piece, a multi-piece unit that may be assembled into a form substantially similar to that shown in FIG. 4 is also possible in accordance with other embodiments of the present invention. In addition, other methods of construction may be used to construct a Plug 70.

The Plug 70 is inserted into the chamber and barrel of a firearm. The Plug 70 has various uses, but finds particular applicability to use in semi-automatic and automatic pistols and certain other semi-automatic weapon systems. Once inserted, the chamber end 72 of the Plug 70 (also marked "A" in FIG. 4) resides in the firing chamber of a firearm. The shaft 74 (also labeled "B") extends into the barrel of the weapon. In one implementation, for example, the shaft 74 runs through the length of the barrel and extends out of the weapon. In this implementation, the shaft 74 may be visible extending from the barrel of the firearm and indicate that the weapon has been disabled. Further, in some cases, installation of the Plug 70 into a weapon requires disassembly of the weapon.

Various measurements are noted on FIG. 4 corresponding to various calibers; however, these measurements are merely exemplary and the Plug 70 can be made to fit other calibers as well. Based upon the disclosure provided herein, one of ordinary skill in the art will recognize a variety of appropriate dimensions that may be used depending upon the particular application. Looked at from the barrel end view 76 or chamber end view 78 of the Plug 70 shown in FIG. 4, it is clear that the Plug 70 is round in this implementation, although other shapes are possible. On the chamber end 72 of the Plug 70, which in this implementation generally resembles a cartridge of whatever caliber weapon the Plug 70 is intended to match, the Plug 70 cannot be engaged by an extractor of a pistol because the Plug 70 lacks a lip present on a typical shell casing. Rather, the Plug 70 in this implementation comprises a bevel 80 disposed (e.g., cut) at a base 82 of the chamber end 82 (part "A") of the Plug 70, as shown in FIG. 4. The bevel 80 allows for the casing extractor in the pistol to not engage and extract the Plug 70 from a chamber of a pistol.

In the particular implementation shown in FIG. 4, at the proximal end (proximal chamber end 82) of the Plug 70, a round nipple 86 extends from surface 84 of the chamber end 72 and resembles the diameter of a primer on a live round. The bevel 80 cut and the nipple 86 serve to prevent the Plug 70 from being extracted from the chamber and allow the Plug 70 to simulate a non-extracted shell casing (the nipple 86 acting as a standoff preventing contact with the extractor). The nipple 86 and the area immediately around it provide a flat surface 44 which serves as an impingement or resting point for an ejector to contact the Plug 70 when it reaches its rear most point of motion, providing an end point for cycle function. Additionally, the nipple 86 and the area surrounding it may allow for dry-firing of the weapon without any damage or only minimal damage to the firing pin due to its direct impingement against the breach face of the slide. In the case where the chamber end 72 of the Plug 70 is of greater diameter than the barrel, the Plug cannot be inserted or removed through the distal end of the barrel. In such a case, the weapon could need to be disassembled to clearly expose the chamber end of the barrel for a sufficient distance to allow for the insertion or removal of the plug 70.

On the barrel end 74 of the Plug 70, there may be a cut out 88 (e.g., the cut out labeled "G") shown in FIG. 4, to which can be affixed a small shackle type lock, making it difficult to remove the Plug 70 from the weapon even when the weapon is disassembled. The Plug 70 can be manufactured to fit a variety of weapons and a variety of calibers.

Figure 5:
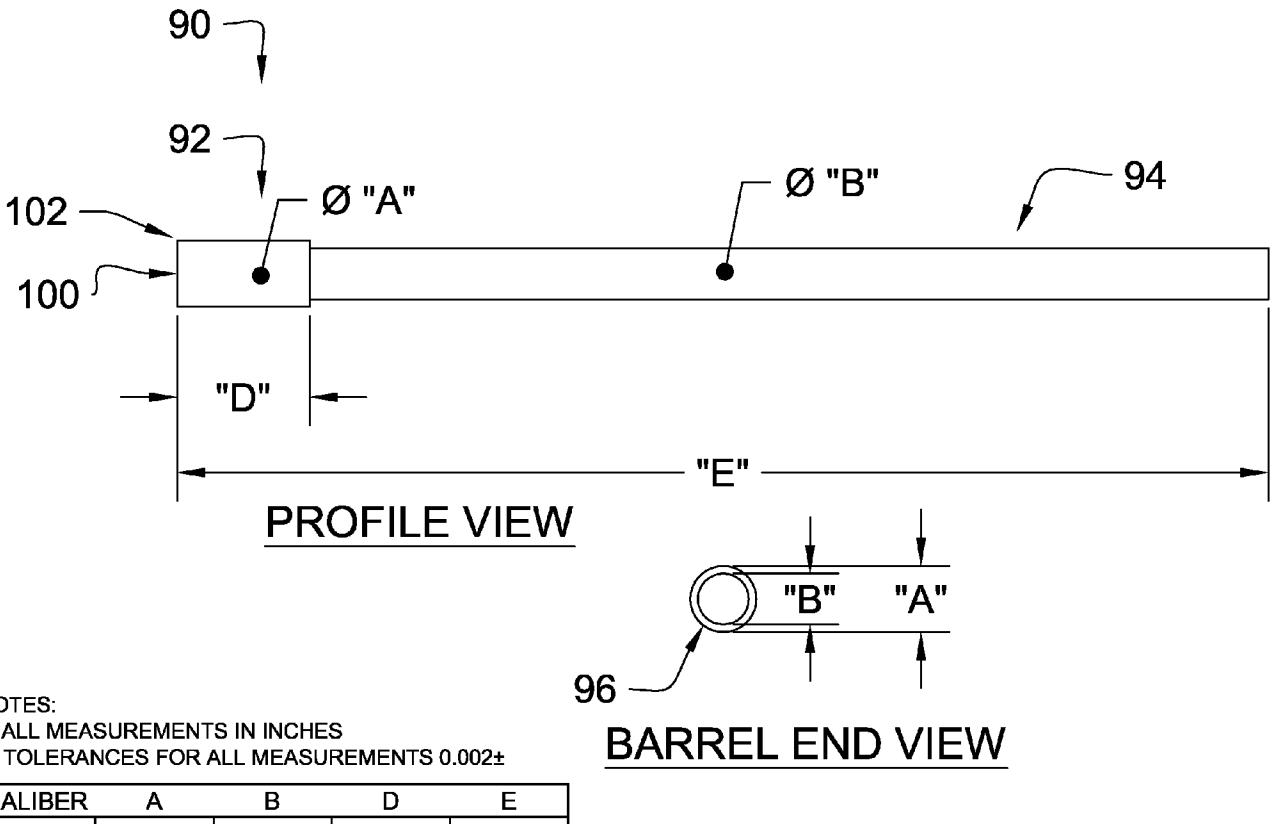
FIG. 5 shows side and end view of another example implementation of a Barrel Training/Safety Plug.

FIG. 5 shows another implementation of a Barrel Training/Safety Plug ("Plug") 90. As described above with respect to FIGS. 1 through 4, the Plug 90 may comprise a single piece or multi-piece device. In the implementation shown in FIG. 5, for example, the Plug 90 comprises a single piece device formed into a generally cylindrical shape or separately formed yet attachable portions. In this implementation, the Plug 90 comprises a generally cylindrical chamber end 92 and a generally cylindrical barrel end 94 or shaft that extends into a barrel of a firearm, such as, but not limited to, a pistol, rifle, or shotgun. One or more pieces or regions of the Plug 90 can be turned on a lathe or injection molded and is formed of plastic, hard rubber, other synthetic material, or soft metal, which may then be coated with Teflon. It should be noted that while FIG. 5 depicts a single piece, a multi-piece unit that may be assembled into a form substantially similar to that shown in FIG. 5 is also possible in accordance with other embodiments of the present invention. In addition, other methods of construction may be used to construct a Plug 90.

The Plug 90 is inserted into the chamber and barrel of a firearm. The Plug 90 has various uses, but finds particular applicability to use in semi-automatic and automatic pistols and certain other semi-automatic weapon systems. Once inserted, the chamber end 92 of the Plug 90 (also marked "A" in FIG. 5) resides in the firing chamber of a firearm. The shaft 94 (also labeled "B") extends into the barrel of the weapon. In one implementation, for example, the shaft 94 runs through the length of the barrel and extends out of the weapon. In this implementation, the shaft 94 may be visible extending from the barrel of the firearm and indicate that the weapon has been disabled. Further, in some cases, installation of the Plug 90 into a weapon requires disassembly of the weapon.

Various measurements are noted on FIG. 5 corresponding to various calibers; however, these measurements are merely exemplary and the Plug 90 can be made to fit other calibers as well. Based upon the disclosure provided herein, one of ordinary skill in the art will recognize a variety of appropriate dimensions that may be used depending upon the particular application. Looked at from the barrel end view 96 or chamber end view 98 of the Plug 90 shown in FIG. 5, it is clear that the Plug 90 is round in this implementation, although other shapes are possible. On the chamber end 102 of the Plug 90, which in this implementation generally resembles a cartridge of whatever caliber weapon the Plug 90 is intended to match, the Plug 90 cannot be engaged by an extractor of a pistol because the Plug 90 lacks a lip present on a typical shell casing. Rather, the Plug 90 in this implementation comprises generally cylindrical chamber end 92 comprising a relatively flat surface 100 disposed to face a firing pin of a weapon. The flat surface 100 without a lip allows for the casing extractor in the pistol to not engage and extract the Plug 90 from a chamber of a pistol.

In the particular implementation shown in FIG. 5, at the proximal end (proximal chamber end 102) of the Plug 90, the surface 100 disposed at the chamber end 102 provides a surface allowing for dry-firing of weapon without any damage or only minimal damage to the firing pin due to its direct impingement against the breach face of the slide. In the case where the chamber end 92 of the Plug 90 is of greater diameter than the barrel, the Plug 90 cannot be inserted or removed through the distal end of the barrel. In such a case, the weapon could need to be disassembled to clearly expose the chamber end of the barrel for a sufficient distance to allow for the insertion or removal of the Plug 90.

Figure 6:
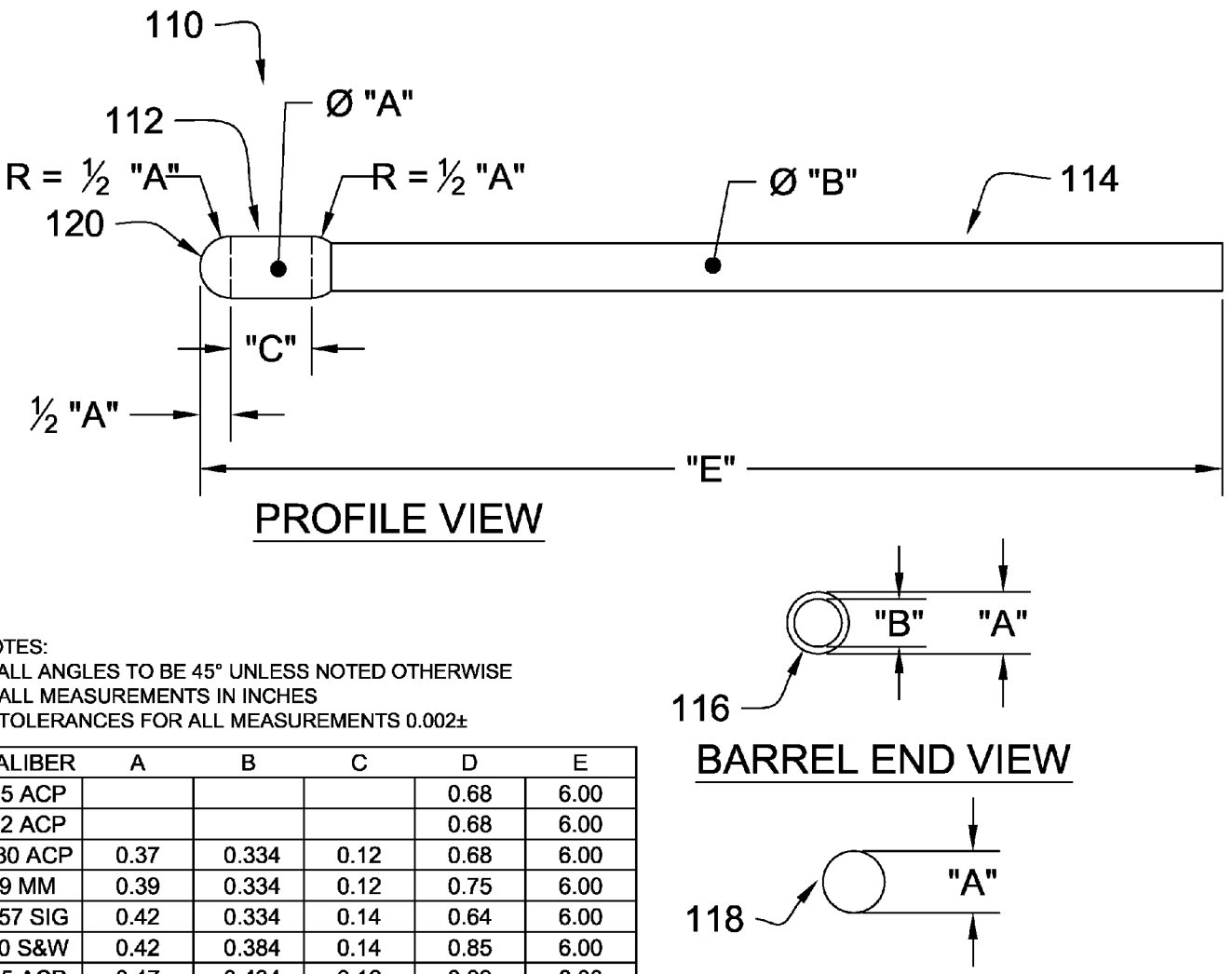
FIG. 6 shows side and end views of yet another example implementation of a Barrel Training/Safety Plug.

FIG. 6 shows yet another implementation of a Barrel Training/Safety Plug ("Plug") 110. As described above with respect to FIGS. 1 through 5, the Plug 110 may comprise a single piece or multi-piece device. In the implementation shown in FIG. 6, for example, the Plug 90 comprises a single piece device formed into a generally cylindrical shape or a separately formed yet attachable portions. In this implementation, the Plug 110 comprises a generally cylindrical chamber end 112 and a generally cylindrical barrel end 114 or shaft that extends into a barrel of a firearm, such as, but not limited to, a pistol, rifle, or shotgun. One or more pieces or regions of the Plug 110 can be turned on a lathe or injection molded and is formed of plastic, hard rubber, other synthetic material, or soft metal, which may then be coated with Teflon. It should be noted that while FIG. 6 depicts a single piece, a multi-piece unit that may be assembled into a form substantially similar to that shown in FIG. 6 is also possible in accordance with other embodiments of the present invention. In addition, other methods of construction may be used to construct a Plug 110.

The Plug 110 is inserted into the chamber and barrel of a firearm. The Plug 110 has various uses, but finds particular applicability to use in semi-automatic and automatic pistols and certain other semi-automatic weapon systems. Once inserted, the chamber end 112 of the Plug 110 (also marked "A" in FIG. 6) resides in the firing chamber of a firearm. The shaft 114 (also labeled "B") extends into the barrel of the weapon. In one implementation, for example, the shaft 114 runs through the length of the barrel and extends out of the weapon. In this implementation, the shaft 114 may be visible extending from the barrel of the firearm and indicate that the weapon has been disabled. Further, in some cases, installation of the Plug 110 into a weapon requires disassembly of the weapon.

Various measurements are noted on FIG. 6 corresponding to various calibers; however, these measurements are merely exemplary and the Plug 110 can be made to fit other calibers as well. Based upon the disclosure provided herein, one of ordinary skill in the art will recognize a variety of appropriate dimensions that may be used depending upon the particular application. Looked at from the barrel end view 116 or chamber end view 118 of the Plug 110 shown in FIG. 6, it is clear that the Plug 110 is round in this implementation, although other shapes are possible. On the chamber end 112 of the Plug 110, which in this implementation generally resembles a cartridge of whatever caliber weapon the Plug 110 is intended to match, the Plug 110 cannot be engaged by an extractor of a pistol because the Plug 110 lacks a lip present on a typical shell casing. Rather, the Plug 110 in this implementation comprises generally cylindrical chamber end 112 comprising a rounded or otherwise shaped surface 120 disposed to face a firing pin of a weapon. The rounded surface 120 without a lip allows for the casing extractor in the pistol to not engage and extract the Plug 110 from a chamber of a pistol.

In the particular implementation shown in FIG. 6, at the proximal end (proximal chamber end 112) of the Plug 110, the rounded surface 120 disposed at the chamber end 112 provides a surface allowing for dry-firing of weapon without any damage or only minimal damage to the firing pin due to its direct impingement against the breach face of the slide. In the case where the chamber end 112 of the Plug 110 is of greater diameter than the barrel, the Plug 110 cannot be inserted or removed through the distal end of the barrel. In such a case, the weapon could need to be disassembled to clearly expose the chamber end of the barrel for a sufficient distance to allow for the insertion or removal of the Plug 110.

Operation

To operate the Plug (such as the Plugs shown in FIGS. 1-6), one disassembles the firearm (e.g., a pistol) and inserts the Plug, barrel end first through the chamber and barrel, seats the chamber end in the chamber, and reassembles the pistol. In some embodiments, to remove the Plug, the pistol must be disassembled. In some cases, for example, there is no other way to insert or remove the Plug. In other embodiments, however, the Plug may be removed without the necessity of disassembling the pistol. In an implementation such as shown in FIG. 4, for example, a user can attach a lock to the barrel end of the Plug which extends beyond the end of the barrel of a weapon to engage a safety notch provided to lock the Plug to within the chamber and barrel of the pistol and/or allow the Plug to remain in place even if the weapon is disassembled.

One purpose of the plug is that by its insertion it renders the firearm, into which it has been properly inserted, entirely inert (i.e., incapable of discharging). Once correctly inserted the firearm is unable to accept a live round into the ramp area or chamber of the weapon. In addition, at the distal end of the barrel the plug may protrude indicating to an observer that the weapon is inert. Because a live round cannot be fired when the Plug is in place, shooter training classes can be held whereby all students, as well as instructors, recognize that the weapons are all disabled, and entirely inert. With the Plug in place, the weapon is rendered inert to the extent that a magazine full of live ammunition can be inserted into the weapon without a possibility of a live round being chambered or fired. The Plug is therefore useful in allowing a shooter to safely train on the actual weapon the shooter uses with a full magazine, thereby matching the weight, size, and configuration of the shooters weapon because it is in fact the actual weapon the shooter plans to use. It is this ability that RCT refers to as "Aspect Correct Training."

In various implementations, the weight of the Plug, made from a lightweight plastic, aluminum or other materials, is negligible relative to the weight of a weapon in which it is inserted and/or relative to the weight of a combination of a weapon and any ammunition installed in the weapon. In these implementations, the Plug has little if any impact on a shooter training with the weapon. The Plug may also provide a malleable surface for the firing pin to impact during dry fire practice sessions and protects the firing pin from any significant damage. Therefore, once the Plug is inserted, the weapon may be dry-fired safely. The weapon may be cycled for additional firing by simply pushing the barrel end of the Plug causing the slide of the weapon to retract under spring tension in the same fashion as it would under recoil if a live round had been fired. This action resets the main spring and hammer and readies the trigger to be reset and re-engaged. This process repeated quickly constitutes what is known as a "trigger reset exercise."

Figure 8A:
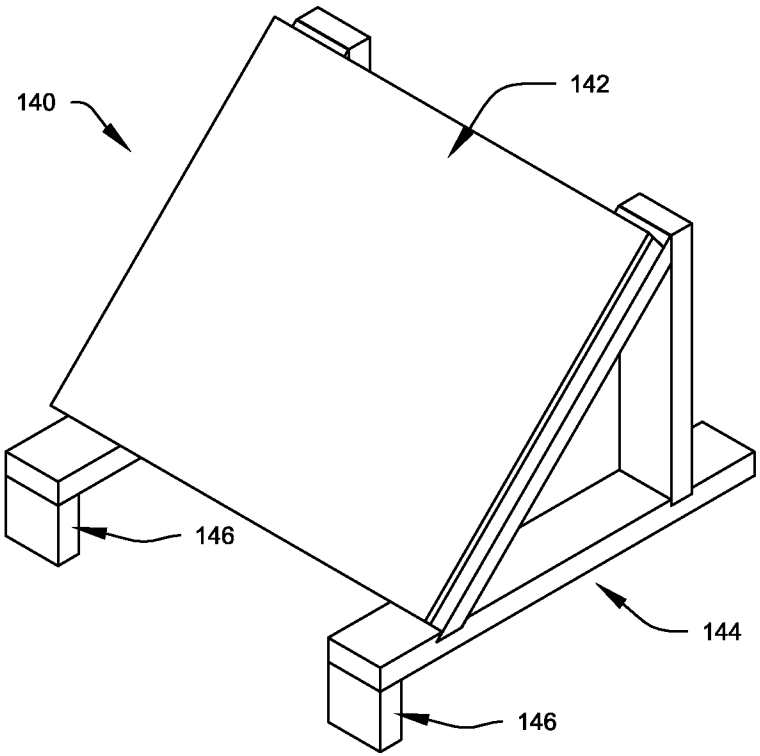
FIGS. 8A and 8B show relief and side views of an example implementation of a trigger reset board.
Figure 8B:
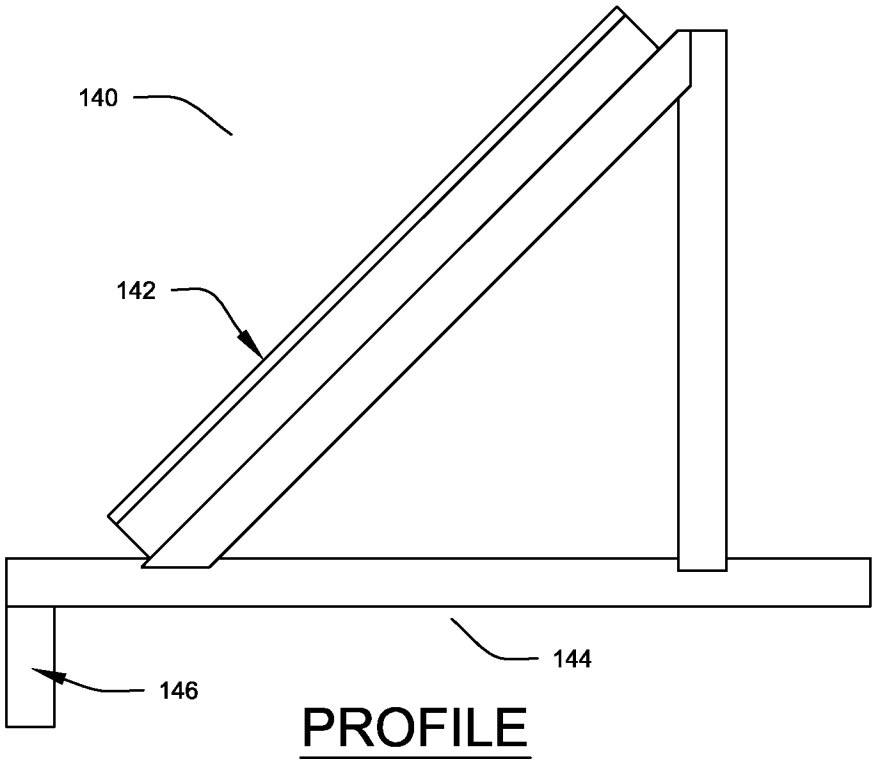

FIGS. 8A and 8B show a relief view and a side view, respectively, of an example implementation of a trigger reset board 140 that may be used with a Plug to cycle a weapon for additional firing. The trigger reset board 140 comprises a strike plate 142 that provides a surface adapted to cycle the weapon by pressing a barrel end of a Plug against the strike plate 142. The strike plate 142 of the trigger reset board 140 is supported by a support frame 144. In this implementation, the support frame 144 is adapted to sit on a surface, such as a top of a table, desk or shelf. The support frame 144, however, may also be free standing. The support frame 144 further comprises at least one stop member 146 adapted to abut an edge of a support surface. The stop member 146, for example, may be placed adjacent an edge of a top surface of a table, desk or shelf to prevent the trigger reset board from sliding along the top surface when the barrel end of the Plug is pressed against the strike plate 142 of the trigger reset board 140. In the implementation shown in FIGS. 8A and 8B, for example, the support frame 144 comprises a pair of stop members 146 attached to the support frame 144. However, one or more than two stop members may also be provided. In addition, one or more frictional members may also or alternatively be disposed on the support frame (e.g., along one or more bottom surface(s) of the support frame) to prevent the trigger reset board from sliding across a support surface. In this implementation, the strike plate 142 is disposed at an angle (e.g., 30, 45 or 60 degrees) from a vertical plane. However, the strike plate 142 may alternatively be disposed generally horizontally or generally vertically.

Training

The field of tactical training has long sought to add the task of accurate reflexive targeting to the list of tasks that can be performed without cognitive attention. Instructors in this field often refer to this reflexiveness as instinctive shooting or Point shooting. However to date the tactical training industry has failed to devise training methods that specifically and successfully train to a point shooting end goal. The most common method used currently by instructors involves body indexing as the means to train point shooting (Ayoob, 2007, p. 88). This method uses an established stance relying on muscle memory but lacks the necessary feedback to make corrections for targeting errors. The inherent weakness in the application of current training methods lie primarily with the use of live fire practice for training the targeting component of shooting. Using live fire the operator's stance is continually disrupted by recoil forces, the disruption of alignment destroys the sight picture disallowing correction to the targeting solution. The shooting stance constitutes the targeting solution. Currently the operator can never reacquire a point of stasis in any exact manner. This eliminates the opportunity for incremental changes to correct targeting errors prior to a triggering decision.

One purpose of the Plug is to provide a training device so that a training procedure known as Reflexive Conditioned Targeting ("RCT") can be used. RCT is a method whereby, with a Plug inserted in the weapon, a laser device can be attached to the protruding plug concentric to the bore of the barrel (at combat distances the projected laser dot thusly attached accurately reflects the impact point of a fired round). This device is designed with a wired tether switch (e.g., a wired tether micro switch) intended to be used by the instructor or by a radio controlled switch. By this means a shooter/student is able to receive feedback (via the laser dot) on shot placement, prior to the recoil cycle disturbing the sight picture. This process eliminates the recoil cycle in the targeting process and allows real time correction in the targeting aspect of shooting. The student is thereby able to learn to accurately target, with the aid of the laser device attached to the Plug.

In one method of training, for example, the instructor calls out the target to be sighted on, the student "hard focuses" on the target and brings the weapon to bear on the target (ignoring the sights entirely) and freezes in the position. This position is defined by RCT as the point of stasis; the position of stance and hand position established through repetition and used by the brain to target accurately. The instructor then depresses a switch at the end of the tether of the laser device and holds it in the ON position thus indicating the actual impact point of a live round had it been fired. The student then corrects the point of stasis such that the laser projects to a point central to the target and re-freezes the firing position in the correct point of stasis at which time the instructor turns off the laser. Repeating this process provides a "closed feedback loop" for the brain to use in determining the correct point of stasis for the firearm when brought to bear on a target. The function of targeting the weapon is separate and apart from that of triggering or firing the weapon. This is a useful aspect of RCT training, as triggering must always be a conscious process attended by cognition regarding target identification, discrimination, and determination of the necessity of a triggering event.

This feedback loop is a visual representation of the impact point for a given shooting stance. In "Trajectories in Operating a Handheld Tool" the authors point to the importance of visual feedback in the accurate operation of a hand held tool when they state "Only with continuous visual feedback, eventual curvature of the trajectory . . . was visible," and "Clearly, with visual feedback information is more accurate than without visual feedback" (Heuer, & Sulzenbruck, 2009, p. 386)

The immediate process of creating this visual closed feedback loop between stance and focal point during training exercises facilitates the proprioceptors quick and accurate adjustment of the stance to the line of sight (Elliot et al. p. 1033). When repeated in spaced intervals these exercises strengthen neuron-pathways that establish LTP in coordinated muscle memory. This training regimen creates a level expertise and automaticity (Ashby et al. 2007, p. 647).

Figure 7:
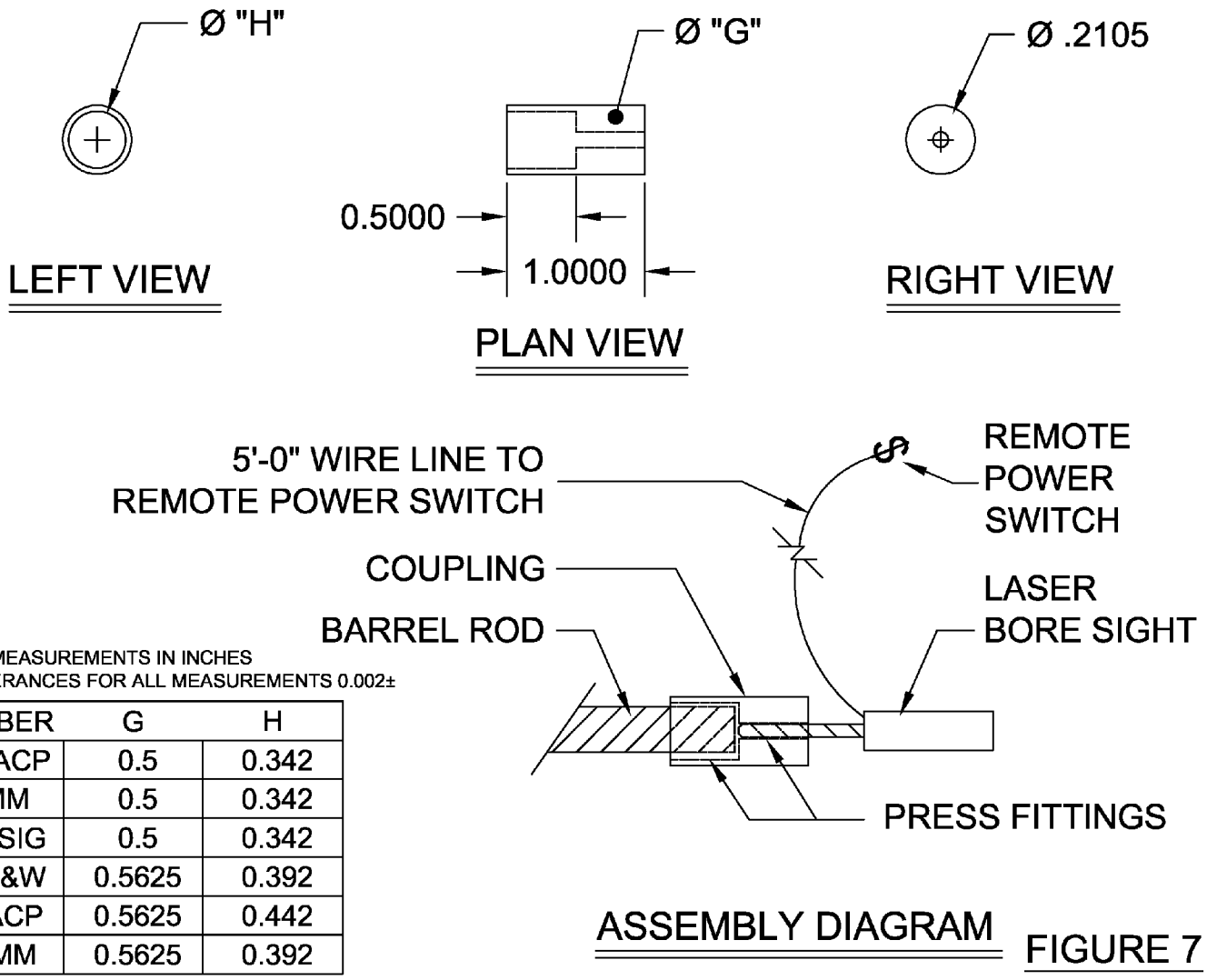
FIG. 7 shows an example implementation of a laser configuration in which a laser can be mounted on any of the Plugs, such as shown in FIGS. 1 through 6.

FIG. 7 shows one example implementation of a laser configuration in which the laser can be mounted on any of the Plugs, such as shown in FIGS. 1 through 6. In this implementation, a laser bore sight is mountable on the barrel end of the Plug extending outside of a barrel of a weapon. In the particular implementation shown in FIG. 7, for example, the laser bore sight may be mounted on the Plug via a connector, such as a press fitting shown. FIG. 7 shows merely one example of a laser bore sight that may be affixed to a Plug mounted within a firearm. Other configurations of lasers and attachment mechanisms may be used to attach the laser(s) to the Plug and/or the firearm for training as described herein. In one implementation, for example, a laser device may threadedly couple with the Plug (e.g., a threaded stud disposed on a proximal end of the laser device may engage a threaded hole in a distal end of the Plug or a threaded stud disposed on a distal end of the Plug may engage a threaded hole in the laser device). In other implementations, the laser bore sight may be coupled to the firearm itself (e.g., via a sight) instead of to the Plug.

An activation switch (e.g., a power switch) of the laser bore sight may be used to selectively activate the laser bore sight at a particular time within the training. In one implementation, for example, a remote activation switch is coupled to the laser bore sight as described above. The remote activation switch, for example, may be wirelessly coupled and/or coupled via a wired connection to the laser bore sight to control the operation of the laser. In another implementation, a remote activation switch of the laser bore sight may be activatable by a student training with the weapon.

Figure 9:
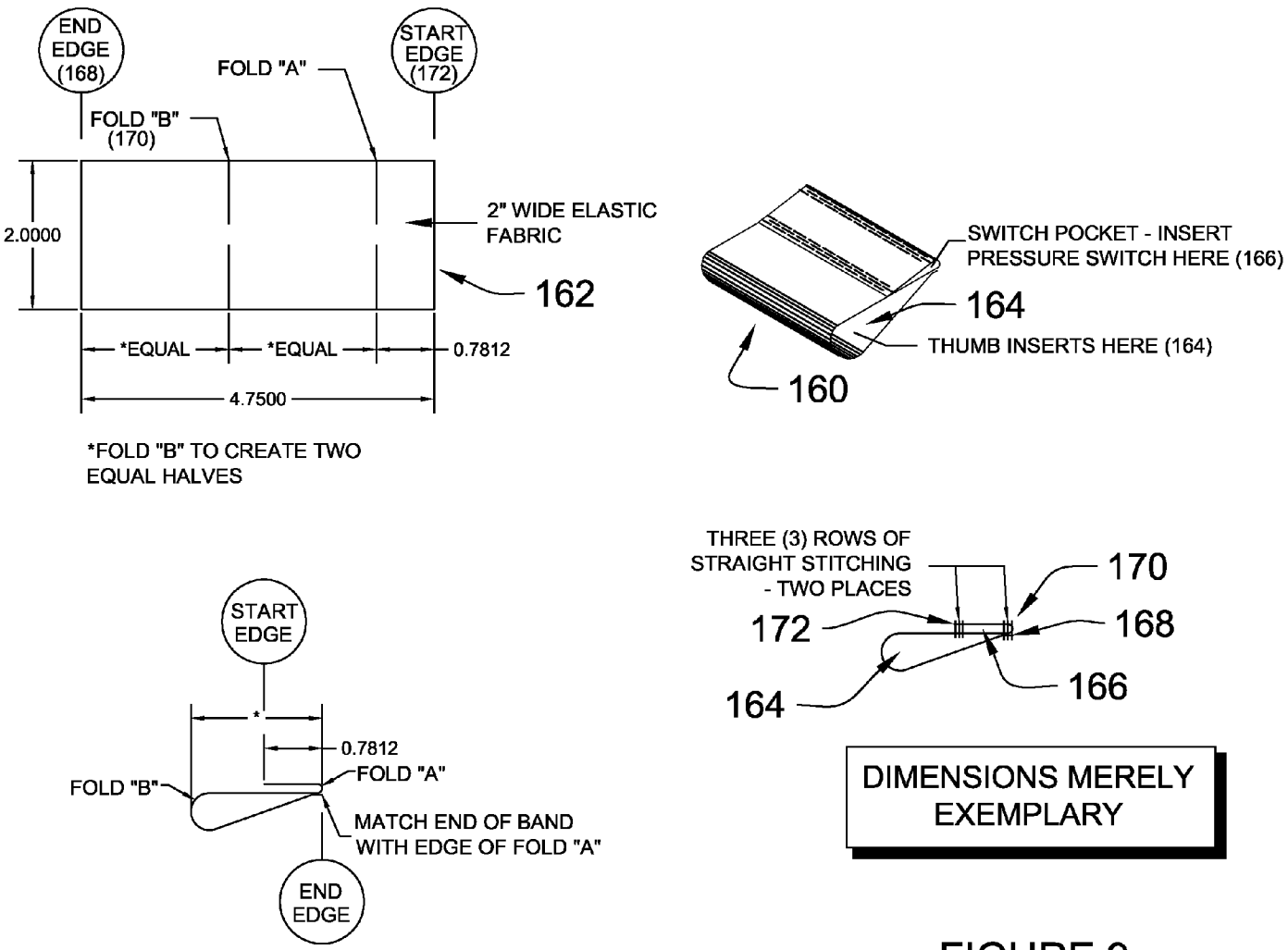
FIG. 9 shows an example implementation of a thumb cuff for use with a laser activation switch.

FIG. 9 shows an example implementation of a remote activation switch for a laser bore sight for a weapon. In this implementation, the remote activation switch is disposed in a thumb cuff 160 that is worn on a student's thumb and can be used by a student to activate and deactivate the laser bore sight during training. In one implementation, the thumb cuff is worn on the thumb of the student's dominant hand. In a pistol grip, the thumb of the student's non-dominant hand overlaps the thumb of the student's dominant hand. Thus, the student can activate the remote activation switch disposed in the thumb cuff by applying pressure (e.g., squeezing) to the thumb of the student's dominant hand with the thumb of his or her non-dominant hand. This allows the student to activate and deactivate the laser without requiring a motion that is unnatural to the student's stance and targeting of the weapon. In addition, the activation of the laser is independent of the trigger action involved in firing the weapon. Thus, the action of squeezing or otherwise applying pressure between a student's thumbs can become an automatized behavior of targeting a weapon while the trigger decision remains cognitive and independent of targeting the weapon for the student.

In the implementation shown in FIG. 9, the thumb cuff 160 comprises a band 162 (e.g., an elastic band) that can be folded about itself (or otherwise arranged) to create a first opening 164 for receiving a student's thumb and a second opening 166 for receiving an activation switch for a laser bore sight. In this particular implementation, a first edge 168 (edge C) of the band 162 is folded to a seam line 170 (B), and a second edge 172 (edge A) is folded back over itself at the seam line 170 (B). The first edge 168 (edge C) is attached (e.g., bonded) to the band at or adjacent to the seam line 170 (B), such as via stitching, adhesive, fusing or other means of attachment. The first opening 164 is formed in the band 162 by the fold and connection of the first edge 168 (edge C) to the seam line 170 (B) for receiving a thumb of a student. The second edge 172 (A) is similarly attached to the band 162 and forms the second opening 166 (e.g., pocket) for receiving a pressure activation switch for a laser bore sight. The thumb cuff, however, is merely one type of housing for a remote activation switch that may be used by a student to activate and deactivate the laser bore sight in training. Although example dimensions are shown, these are merely exemplary and are in no way limiting.

With the Plug in place, the weapon may also be used to train a student in the correct aspects of triggering the weapon. In one implementation, this process of training is performed as an entirely separate sub-set of the training process and is not done in close temporal proximity to the targeting exercises. In this implementation, this process can be done without aid of the laser attachment. Once the weapon is held in a proper shooting stance, (the student's point of stasis) the student can, by simply pushing the end of the Plug against a hard surface, like a wall or a trigger reset board, cycle the slide of the weapon as if it had been fired. The student does not need to release the off side hand to retract the slide manually. This action forces the plug rearward in the barrel forcing the slide to impinge against the recoil spring, resetting the trigger mechanism, and the main spring, (cocking the hammer, or striker) and then, upon release, allows it to return to full battery. This process is known as "trigger reset cycling". This aspect of design is useful to RCT training. Trigger reset exercises are a "dry fire" aspect of RCT training in that the repeated process allows for LTP or long term potentiation, the process commonly referred to as muscle memory.

In one particular implementation, an example method of training comprises the following operations: (1) the student brings a cocked weapon to bear in a correct point of stasis stance, (2) the student presses the trigger gently to take up the initial slack in the mechanical system (at this point the student can feel the pressure of the sear in the mechanism), (3) the student further presses the trigger to break the sear allowing the hammer or striker to fall driving the firing pin into the plug and continues to press and "pin" the trigger in it rearward most position, (4) the student then drives the protruding plug end into a wall or other hard surface causing the recycling of the trigger mechanism, the main spring and the hammer or striker, (5) the student gently releases the trigger from its pinned position just until the "click" of the mechanical reset mechanism can be heard then presses the trigger again just to the sear point, or that point where the pressure on the sear can be felt then the student pauses, before repeating another cycle. In one particular implementation, the pause can be critical to a training function as a cognitive process is accompanied by each break of the sear. If the student simply pulls the trigger through its full cycle each time absent the pause, then in real time tactical engagement the same process would be expressed, meaning there would be rapid and continuous pulling of the trigger until the gun empties and no rounds remain (a phenomenon recorded in many shooting incidents where the student keeps pulling the trigger until the gun is empty). This is referred to in RCT as "emergency expression of automatized behavior." At this juncture the process repeats beginning now at step 3. The design of the barrel plug allows for quick recycling and uninterrupted trigger reset exercises to be performed all while holding an aspect correct weapon presentation and in a correct point of stasis stance. It should be noted that some variance in the order of the aforementioned steps and/or repetition may be possible in accordance with other embodiments of the present invention.

The establishment of these "short stroke" muscle actions are useful to student's training in that the ability to effect a "double tap" (the firing of two rounds within the space of a single recoil cycle) is dependent on establishing the LTP or muscle memory developed in the "trigger reset" exercise. Effective training may rely on repeating the process over and over during a particular practice session, and then using "Short interval" repetitions of sessions to embed the action through LTP establishing an automatized behavior RCT refers to as Shaped Behavioral Sets into the muscle memory.

Muscle memory, also known as motor learning, is a form of procedural memory that involves consolidating a specific motor task into memory through repetition. When a movement is repeated over time, a long-term muscle memory is created for that task, eventually allowing it to be performed without conscious effort. This is what is referred to as Long Term Potentiation (LTP). This process decreases the need for attention and creates maximum efficiency and speed within the motor and memory systems. Examples of muscle memory are found in many everyday activities that become automatic and improve with practice, such as riding a bicycle, typing on a keyboard, playing a melody or phrase on a musical instrument. At a cellular level, motor learning manifests itself in the neurons of the motor cortex. It has been shown that the behavior of certain cells, known as "memory cells," can undergo lasting alteration with practice. See Bizzi, E., Accornero, N., Chapple, W., & Hogan, N. (1984). Posture control and trajectory formation during arm movement. *The journal of neuroscience,* 4(11), 2738-2744. Motor learning is also accomplished on the musculoskeletal level. Each motor neuron in the body innervates one or more muscle cells, and together these cells form what is known as a motor unit. For a person to perform even the simplest motor task, the activity of thousands of these motor units must be coordinated. It appears that the body handles this challenge by organizing motor units into modules of units whose activity is correlated. RCT has defined these "modules of units" as Shaped Behavioral Sets (SBS's). It is the establishment of just this form of Muscle Memory related to targeting that RCT methods and equipment specifically train to.

Using the Plug and Laser attachment in the manner described above the muscles related to body stance, hand position, arm position, head position and even how the eyes are held in position within the eye socket, are trained into synchronous alignment or a Shaped Behavioral Set. Targeting then, through repetition of the laser targeting exercise, becomes a function of automatized trained behavior directly related to head and eye position. Meaning that where the head and eyes look the muscles of the trunk of the body, and of the shoulders, arms and hands follow in such synchronicity that the fired round impacts where the eyes have focused on. Rapid repetition and close interval between repetition sessions are useful to the establishment of these Shaped Behavioral Sets. RCT and the Barrel Plug and its attachments allow for "Aspect correct" practice in the establishment of the requisite SBS's in that the student is able to use the exact weapon, not a plastic replica, in the training sessions. The student is able to hold the weapon in the correct shooting stance (point of stasis) and operate the slide, via the Plug, without releasing the correct grip (thus losing the point of stasis) and still cycle the slide and reset the trigger. The current state of art and function is to use the off side or weak hand to retract the slide to affect the reset of the trigger. In this manner the point of stasis is lost and the training loses effectiveness. RCT and the Barrel Plug allow the student to affect repetition after repetition without releasing the aspect correct grip, maintain correct point of stasis, and once trained correctly in its operation, to perform the function quickly, without the need for intervention or assistance by the instructor.

Reflexive Conditioned Targeting and its training methods make use of the Plug. These training methods are unique and depend on the Plug. RCT will greatly enhance the ability of the student, whether civilian, law enforcement, or military, to be trained much more quickly and efficiently in the use of targeting and triggering a pistol. RCT training creates the ability to specifically train accurate targeting so that it becomes a virtually automatic response. In RCT, the targeting process is intentionally slowed down to the extent that the impact point of the round can be seen, critiqued, corrected, reinforced or refocused if necessary before any recoil cycle spoils the site picture. When practice is done with live rounds, the recoil makes effective feedback virtually impossible.

A review of how targeting solutions are determined, and the identification of the key components that comprise some implementations of training systems are provided below. In the targeting process there are several key elements:

1) Target identification

2) Threat assessment, or what level of threat does the target in question pose?

3) Weapons system presentation or establishing the presence of the weapons system platform in a tactical location within the battlefield environment.

4) Weapon system alignment, or targeting; bringing the weapons system to bear on the target with the consideration of distance, movement of target, and ballistic performance of the weapon and ammunition.

5) Triggering decision and variations of triggering actions. Determining if the level of threat surpasses the ROE (Rules of engagement), and then determining what triggering actions are called for i.e.: single shot, double tap, cover fire, multiple double tap's, single "Target" shot, i.e.: closely held hostage head shot.

In an automated electromechanical system such as the CIWS (Close In Weapons System) deployed on many Naval vessels, these functions are carried out in a coordinated and mostly automated manner by subsystems such as radar, trajectory computer, and the fixed weapons platform on the deck of the ship. Radar identifies potential threats, determines distance, course and speed and forwards the information to the trajectory computer. The position of the weapons platform is controlled by electro/hydraulic servos that move the weapon through its primary and tertiary axes. Sensors within the platform provide a real time closed feedback loop and relay any positional changes to the trajectory computer to be used in the trajectory calculations. Determination of threat and degree of threat in addition to triggering decision are effected by personnel trained in the correct implementation of Naval policy related to target engagement. During the initial installation of such a system, a calibration process is undertaken wherein the exact positional relation of the weapons platform is linked and calibrated to the computers trajectory program parameters. This calibration process ensures that the weapon is pointing in exactly the direction the trajectory component is using to calculate the targeting solution. Absent the calibration process the computer is essentially shooting blind.

Taking this as a model for small arms engagement and targeting, RCT Training combines the barrel plug, its several utility functions, and the laser mount to establish and replicate the automatized functions of the CWIS, and also replicate its closed feedback loop via the real time recognition of shot placement relative to targeting solution and weapons platform alignment. The other components of the CWIS system are replicated in the biological functions of several sub-systems within the human body. The eyes take on the duties of the radar, identifying and tracking threats, determining distance, course and speed. Weapons presentation is carried out by the SBS established in the "Drawing of the weapon" portion of training. The shooting stance establishes a fixed platform for the weapons system. The proprioceptor system acts as the sensors of the weapons platform, letting the brain/computer know of the exact positional aspect of the weapons platform and allows minute corrections. Proprioceptors are the set of senses that inform each part of our body the exact positional location of every other part. Proprioceptors allow us to walk without having to look at our feet. They allow us to climb stairs without looking at each step; they allow us to touch our nose with our eyes closed. In short proprioceptors serve to align our body parts to perform any specific task.

Targeting is carried out by the synchronous alignment of "focal point" of the eyes (radar) and the shooting stance, (weapons platform) provided by the receptors of the proprioceptor system and the "calibration" process established during the RCT Training process described herein. RCT Training follows the Part Task Training approach of segmenting individual aspects of process flow and operations into smaller sub units of processes. See Kirlik, A., Fisk, A., Walker, N., & Rothrock, L. (1998). Feedback augmentation and part-task practice in training dynamic decision-making skills. *Making Decisions Under Stress Implications for individual and team training, Chapter* (5), 91-113. These sub units of processes are what RCT refers to as Shaped Behavioral Sets (SBS's). In one implementation, the SBS's of RCT comprise the following:

1) Weapons presentation, a five step process (drawing the pistol from holster, concealed or otherwise).

2) Bringing the weapon to bear down range in correct shooting stance.

3) Targeting, bringing the weapon into alignment with focal point of eyes.

4) Reloading procedures. (Speed reload, Reload w/retention, and Tactical reload)

5) Malfunction clearing Processes. (Type I, H, &III)

6) Trigger engagement Phases. (Touching trigger, Initial uptake, Break sear, Reset, Re-uptake, Re-break)

7) Un-deploying weapon, or Re-holstering.

Various Barrel Plugs described herein are highly useful in performing these training procedures safely.

Each of these processes when practiced with exacting standards creates an individual or standalone SBS that becomes an automatized behavior and thus requires little or no cognitive expenditures. See Kirlik, A., Fisk, A., Walker, N., & Rothrock, L. (1998). Feedback augmentation and part-task practice in training dynamic decision-making skills. *Making Decisions Under Stress Implications for individual and team training, Chapter* (5), 91-113. The demands on cognitive processes during a tactical engagement can be overwhelming. See Zachary, W., Ryder, J., & Hicinbothom, J. (1998), Cognitive task analysis and modeling of decision making in complex environments. In J. Cannon-Bowers (Ed.), *Making decisions under stress* (pp. 315-344). Washington, DC: American Psychological Association Zachery likens these processes and requisite performance knowledge bases within the brain to a black board. Perceptual events are posted on the blackboard in hierarchal order. Zachary refers to these as perceptual demons. Zachary states "A demon is spontaneously activated and executed whenever the corresponding sensory event typically a verbal or visual cue is sensed." A tactical operator's attention resides on only one task at any given moment whatever that specific task is. Automatized behaviors and cognitive processes can run concurrent and in parallel during singular temporal events. Like listening to music and singing along while driving. Two actions some cognitive process, some automatized. In a tactical environment cognitive resources are at a premium due to the high stakes normally associated with live fire aggression or defense. An operator's attention can be shifted in one of two ways. First attention can be shifted when some perceptual posting has a higher priority than the current task. Second attention can be suspended while some external task is performed where delays are expected and the cognitive processes can be focused on higher priority tasks.

RCT is unique in that it allows the process of targeting, or accurate alignment of weapon system to intended target, to become one of the sets of automatized behavioral processes spontaneously triggered by a perceptual demon in a tactical environment. Removing the need to cognitively sight in the weapon; (which requires looking for the sights on a weapon, align the dots creating a sight picture, and then superimpose the sight picture over the intended target), leaves room for other higher priority processes on the cognitive blackboard. Processes such as target identification, target discrimination, identification of innocents within the tactical environment, tracking multiple targets, and triggering decisions are all examples of higher priority decisions competing for limited cognitive capacities.

RCT Training segments and specifically trains the several processes involved in the tactical deployment of small arms allowing them to be relocated from the Somatic nervous systems set of conscious reactions (which are inherently slower due to the need for cognitive processing), to the quicker reacting autonomic nervous system where they become an automatized reference library of behavioral responses available to be put into action by the Fight or Flight system. Among these processes is the "Key" procedural training unique to RCT that of Targeting.

Central to the unique nature of RCT's process is the ability of the barrel plug and the attached laser device to create a training environment wherein the process of calibrating the shooting stance to the focal point of the eyes via conditioned responses within the proprioception system. This process is akin to the calibration of the CWIS system. Through the principles of operant conditioning and the creation of a closed feedback loop via the plug and instructor fired laser RCT creates a conditioned synchronous alignment of shooting stance or platform to head alignment and the focal point of the eyes. Current art has no such ability.

In the current art of small arms training environment live fire is consistently used as the means of determining the accuracy of targeting solutions. The operator brings the weapon to bear on the target, aligns the mechanical sights and pulls the trigger. At this point the recoil of the weapon disrupts this point of stasis, the weapon moves into the field of view of the operator and has to be lowered at which point the operator looks to see if the shot was on target. The operator is then left to attempt to recreate the point of stasis, correct the alignment of the weapon in hopes of correcting the point of impact, and pull the trigger again to see if an accurate adjustment was made. Again the weapon moves under recoil, point of stasis is disrupted and the whole process starts over. Current art focuses on several different theories of "use of sights", trigger control, and muscle tension to attempt to affect more accurate shot placement. Some systems are developed using instantaneous laser fire as a means of determining a student's established accuracy or shot placement. These systems use an instantaneous laser pulse directed at laser sensitive targets that record hits or misses. These make no accommodation for instructor initiated, sustained laser placement, or the ability to correct alignment to focal point for reestablishment of correct stance. These are simply designed to provide controlled shooting scenario environments to practice existing skills absent live fire and the expense of ammunition.

Reflexive Conditioned Targeting, (RCT) closes the training loop for small arms, particularly hand gun training. RCT separately trains accurate targeting driven by the conditioned proprioceptor system absent live fire. RCT applies the classical conditioning principles from psychology and the sensor and alignment abilities of the Proprioceptor system to the handgun training regimen. RCT accomplishes this by creating a unique combination of equipment and process that for the first time closes the feedback loop for accurate small arms targeting before the operators sight picture is disrupted by recoil. RCT allows accurate targeting corrections to be effected and embedded in automatized behavioral memory through LTP, absent the disruption of recoil to the shooting platforms point of stasis.

RCT training replicates the initial calibration process in a mechanical system through repetitive, closed feedback loop conditioning which links the positional aspect of the shooting stance to the operator's head position and focal point. RCT targeting becomes a separate stand-alone training process not interdependent on live fire practice. Once RCT training is complete the Long Term Potentiation and related proprioceptor connectivity is established between focal point and shooting stance. Live fire then becomes only a process to test and check training effectiveness and to monitor the need for interval training to maintain the performance requirements for tactical operators specific needs.

RCT allows the original position of the weapon to be maintained once the weapon is "fired" by using a laser attached to the Plug. Because there is no recoil, and because the weapon is very close to its actual weight when using the Plug, RCT allows for Aspect Correct training and real time corrections to shot placement relative to the site picture, and, within a very short time, conditions the muscles in the arms, hands, and body to be aligned with the eyes of a student. The Barrel Plug and its accompanying laser device make this type of training possible.

As described above a separate RCT exercise is used for triggering (trigger reset exercise) so that the targeting and triggering functions are functionally separated, allowing for the body to quickly target reflexively, leaving all cognitive resources available to make a decision as to whether to trigger. In one implementation, the Plug is central to RCT training because it renders the gun completely inert; it allows the student to use his or her own weapon in training in order to get an aspect correct feel for targeting and trigger pull with that weapon; it allows for the safe use of a full magazine in training to replicate the actual weight and characteristics of the weapon; it allows the student to dry-fire the weapon while protecting the firing pins' integrity; it allows the student to practice triggering; it protects all students who are working together. In some cases, the weapon must be disassembled to remove the Plug. This temporal aspect to the design and intent of the plug can be useful in particular settings. Although the Plug is used in various implementations, however, the training method may be used without the Plug. Other methods of providing an inert firearm, or protecting the firearm from damage during dry-fire may be used. Where a trainee is training alone (e.g., knowing the gun is not loaded) or in a trusted environment (e.g., on a range), the trainee may use various training methods disclosed herein without the need to ensure that the gun is inert.

The Plug's use in training law enforcement, military, and civilian populations is significant. A single instructor can teach large groups of trainees so long as the barrel Plug is used. There is no need to have safety observers for every few trainees. A simple glance can inform the instructor whether all the weapons have a Plug in place. Again the temporal requirements for removing the plug allow for intervention prior to a live round entering weapon. An additional design feature in the training market is that the plug allows for practicing malfunction clearing exercises in a classroom setting. Currently these have to be practiced on a live fire range with a high student to instructor ratio usually between 4-1 and 6-1. While the procedures for clearing malfunctions vary by school and instructional discipline, the basic requirement of having live ammunition chambered is universal. The Plug acts as the malfunctioning round for type I and H malfunctions, (Type I failure to fire and Type II failure to extract, respectively) where normally a live round would need to be chambered in some part of the clearing exercise. In a type III, (stove pipe) the chamber begins empty but ends with a live round in the chamber. In all of these areas the procedures can be followed and practiced with a Plug in place insuring no live rounds enter the chamber, but allowing for full function clearing practice to take place in a classroom not on a range. Again the ratio here can be one instructor to a room full of students due to the inert nature of each weapon.

Additionally as a safety and training device in the home setting the plug allows for all the same training practice to be performed in home just as safely as in a classroom or on a range. The student can also practice the laser targeting process using a thumb cuff elastic band which houses a pressure sensitive switch to activate the laser. Recall that the triggering aspect of training needs be separated from the targeting training. In this application the switch for the laser is attached via an elastic thumb cuff worn on the strong side hand (trigger finger hand) but on the thumb, the off side, or weak hand thumb normally rests atop the strong side thumb and as such is used to apply pressure to the cuff thus activating the switch. In this manner one can practice targeting solo, once taught the procedure and rationale behind the process—namely, the importance of not pressing the trigger to activate the laser.

In the current art there are numerous laser devices used to "practice shooting" without the need of live rounds and a range. One distinguishing design feature for the Plug and RCT training is the ability to refrain from use of conventional sights, and the development of SBS's to effect target alignment via operant conditioning of the proprioceptors. Current art simply uses a projected laser to target directly, during live fire, or uses a projected laser pulse initiated by dry fire to identify hits using conventional sight methods. None of these allow for the continuous presence of a laser dot such that correction can be made for each shot prior to continuing on to the next.

Lastly, as a child safety device for use in the home the Plug stands unique in design, and application. As the weapon is in need of disassembly to install the plug, conversely it will generally also require disassembly to remove the plug. A correctly installed Plug with a lock affixed to the lock notch requires several things be in place in order for the plug to be removed. First, the key to the lock should be present and the user able to effect the operation of the lock. Second, the user should be in possession of a highly specific and somewhat technical knowledge base as to the operational aspects of the particular weapon, specifically the procedures for field stripping. This knowledge base is by no means universal, but unique to each weapon design. Were a child of any age able to cut the lock or defeat its purpose in some other manner, or able to cut the plug its self, a second tier of protection exists in that the child must now accurately disassemble the weapon, remove the plug and in exact reverse order reassemble the weapon before the weapon could be loaded and used. Current art described above, provides only one tier of protection. The lock itself. Once defeated the weapon becomes immediately operational. The Plug's efficacy as a deterrent to a child relies on an entirely different multi-tier philosophy of security.

Tier I—Operating a lock and key requires a certain and specific level of cognitive mental development. Thus, if a child of lesser development had both the gun with a lock and the correct key the child lacks the mental capacity to operate the lock. Tier II—If a child of higher capacity has the locked gun and no key it requires an additional level of development to think in the abstract and devise a plan to defeat the lock or the plug. Tier III—If a child of sufficient development has the lock removed either by use of a key or by defeating the lock or plug (cutting it). It requires still an additional level of development to either access directions for disassembly, then correctly follow the directions, disassemble the weapon, remove the plug and then reverse the process accurately, or to figure out the process by trial and error, in the absence of directions and find success in the attempt then reverse the process and end up with an operational weapon. The development of intellect as defined by the current state of discovery in the field of psychology is fairly stable. As such children, generally those below the ages of between 7 and 11 years are still in the Concrete operational stage of development as defined by Jean Piaget—a stage of development unlikely to produce an intellect able to overcome the complexity of disassembly and reassembly, without directions. See Ginsberg, H., & Opper, S. (1979). *Piaget's theory of intellectual development*. (p. 152). Prentice Hall. Only in the Formal operational stage will such functions be likely. While these stages are by no means absolute, and some children develop faster than others, a weapon left in this condition will still have a timer of sorts running, how long will it take to overcome all the obstacles? The Barrel Safety Plug is not designed or intended as a primary means of preventing a child from usable access to a firearm. Gun safes and lockable cabinets are always a better choice. It will, however, pose a significant obstacle to overcome should a weapon be inadvertently left alone during a practice session and a child happens upon it. Temporal barriers to overcoming the several tiers of protection offer significant obstacles preventing quick accidental discharge by a child.

As described above, the Plug can be used for learning to target quickly and accurately and also can also be used to facilitate dry-fire exercises allowing students to learn to clear malfunctions and to pull the trigger rapidly while still under the control of the cognitive functions of the brain.

Usefulness of the operational tools and techniques of RCT can be understood from the foundational work of several renowned researchers. In particular, Edward Lee Thorndike first described the principles of operant conditioning, and muscle memory. These principles underwent further refinement in the work of B. F. Skinner. The principle of Long Term Potentiation, the ability of neurons to form stronger and long lasting signal transmission as a result of simultaneous stimulation was discovered by Terje Lomo in 1966 in Oslo, Norway (Lomo, 2003). The term Proprioception was first used by Charles Scott Sherrington in 1906 and defined it as an awareness of motion and position derived from muscular and tendon sources. And the finally the principles of behavioral shaping are also the work of B. F. Skinner.

RCT combines principles from these areas in several ways to accomplish the goal of reflexive accurate targeting. This is accomplished by generating a visual representation of the impact point of a fired round from a given shooting stance absent any recoil cycle. A remotely fired laser affixed to the weapon creates this visualization of expected impact point. RCT holds that the proprioceptive feedback related to the shooting stance along with the visual feedback for impact point provide the basis for correcting the discrepancy between focal point and the shooting stance. This is supported by R. S. Woodworth (1889), as cited in Elliot, D., Hansen, S., Grierson, L., Lyons, J., Bennett, J., & Hayes, S. (2010). Goal-directed aiming: two components but multiple processes. *Psychological Bulletin,* 136(6), 1023-1044 (p 1023).

While these studies were focused on limb control to directly hit a target, the principles hold true for RCT. In RCT the equivalent of Elliot's target is the final resting point of the shooting stance. Ashby et al. supports RCT's premise that the conditioned SBS processes for the other functional aspects can enter the realm of automaticity which will create additional efficiencies in cognitive tasking. (Ashby et al.) Elliot et al. states that these types of actions improve in speed and efficiency with practice, "reducing the discrepancy between the limb and target position" (Elliot et al. p. 1034).

Figure 10A:
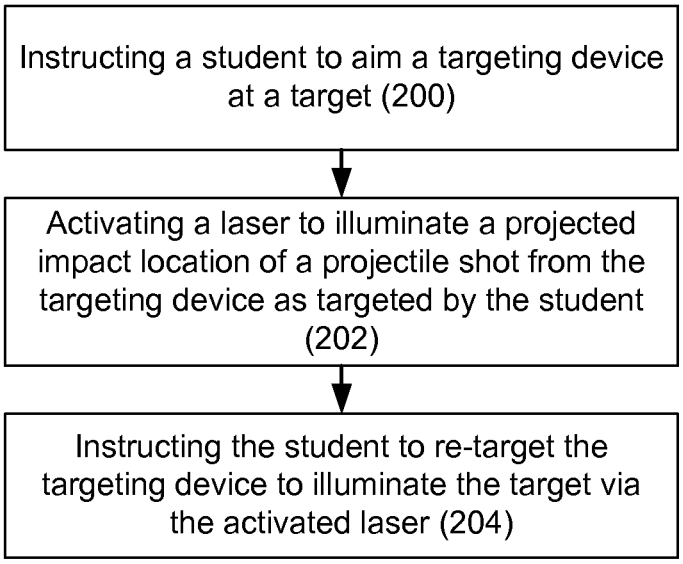
FIGS. 10A and 10B show example processes of training a student to target a weapon.
Figure 10B:
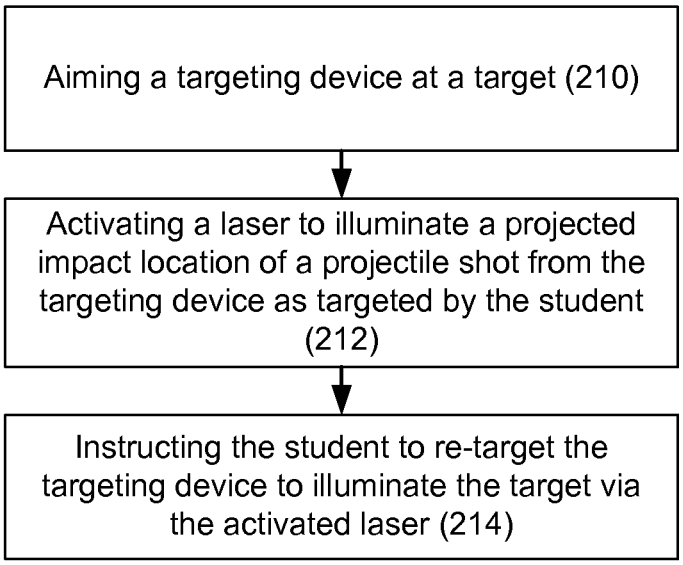

FIGS. 10A and 10B show flow charts of example processes. FIG. 10A, for example, shows an example process to teach targeting a firearm or other targeting device. The process comprises: instructing a student to aim a targeting device at a target (operation 200); activating a laser to illuminate a projected impact location of a projectile shot from the targeting device as targeted by the student (operation 202); and instructing the student to re-target the targeting device to illuminate the target via the activated laser (operation 204). The re-targeting process provides a feedback loop to the student for correcting the student's targeting skills.

FIG. 10B shows an example process of training to target a targeting device. In this implementation, the process comprises: aiming a targeting device at a target (operation 210); activating a laser to illuminate a projected impact location of a projectile shot from the targeting device as targeted by the student (operation 212); and re-targeting the targeting device to illuminate the target via the activated laser (operation 214). The re-targeting process provides a feedback loop to the student for correcting the student's targeting skills.

Although several embodiments of this invention have been described above with a certain degree of particularity, those skilled in the art could make numerous alterations to the disclosed embodiments without departing from the spirit or scope of this invention. For example, although the methods described herein refer to training for targeting and operating a firearm, the methods may also be used for training for targeting and operating any other device, such as a bow, a crossbow, or the like. All directional references (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

What is claimed is:

1. A generally cylindrical training/safety plug for use in firearms, the plug comprising:

a generally cylindrical chamber end having a size adapted to fit within a chamber of a designated firearm, the chamber end having a cross-sectional dimension sufficient to prevent the chamber end from extending into a barrel of the designated firearm, the generally cylindrical chamber end further comprising a strike surface for receiving an impact of a firing pin of the designated firearm and a proximal end dimension such that the chamber end is not engaged by an ejector mechanism of the firearm; and a generally cylindrical shaft comprising a barrel end coupled to and extending distally from the generally cylindrical chamber end; the barrel end of the generally cylindrical shaft further adapted to extend through the barrel of the designated gun and extend beyond an end of the barrel, wherein the training/safety plug renders the designated firearm inert when the chamber end is disposed in a chamber of the firearm and the barrel end extends into the barrel of the firearm, the cross-sectional dimension of the chamber end prevents removal of the plug through the distal end of the barrel and removal of the plug requires the firearm to be disassembled to expose the chamber end of the barrel, wherein the cylindrical training/safety plug comprises a single piece of material, and a laser bore sight coupled to the barrel end of the plug.

2. The generally cylindrical training/safety plug as recited in claim 1 wherein the generally cylindrical chamber end comprises at least one bevel adjacent the strike surface for preventing an ejector mechanism of the firearm from ejecting the plug.

3. The generally cylindrical training/safety plug as recited in claim 1 wherein the generally cylindrical chamber end comprises a shape and dimension approximating a live fire round for the designated firearm without a lip of the live fire round.

4. The generally cylindrical training/safety plug as recited in claim 1 wherein the laser bore sight is mounted along a longitudinal axis of the shaft of the plug.

5. The generally cylindrical training/safety plug as recited in claim 4 wherein the laser bore sight is mounted to the shaft of the plug via at least one press fitting.

6. The generally cylindrical training/safety plug as recited in claim 4 wherein the laser bore sight and the shaft are threadedly engageable.

7. The generally cylindrical training/safety plug as recited in claim 1 further comprising an activation switch operably coupled to the laser bore sight.

8. The generally cylindrical training/safety plug as recited in claim 7 wherein the activation switch is disposed in a cuff wearable by a trainee.

9. The generally cylindrical training/safety plug as recited in claim 8 wherein the cuff comprises a thumb cuff.

10. The generally cylindrical training/safety plug of claim 1 further comprising a reset trigger board comprising a strike surface adapted for cycling the firearm by pressing the barrel end against the strike surface.

11. A process to teach targeting a firearm using a generally cylindrical training/safety plug-the process comprising:

instructing a student to aim a firearm equipped with the generally cylindrical training safety plug at a target without a laser being illuminated, wherein the generally cylindrical training/safety plug comprises: a generally cylindrical chamber end having a size adapted to fit within a chamber of a designated firearm, the chamber end having a cross-sectional dimension sufficient to prevent the chamber end from extending into a barrel of the designated firearm, the generally cylindrical chamber end further comprising a strike surface for receiving an impact of a firing pin of the designated firearm and a proximal end dimension such that the chamber end is not engaged by an ejector mechanism of the firearm; and a generally cylindrical shaft comprising a barrel end coupled to and extending distally from the generally cylindrical chamber end; the barrel end of the generally cylindrical shaft further adapted to extend through the barrel of the designated gun and extend beyond an end of the barrel, wherein the training/safety plug renders the designated firearm inert when the chamber end is disposed in a chamber of the firearm and the barrel end extends into the barrel of the firearm, the cross-sectional dimension of the chamber end prevents removal of the plug through the distal end of the barrel and removal of the plug requires the firearm to be disassembled to expose the chamber end of the barrel, wherein the cylindrical training/safety plug comprises a single piece of material, and a laser bore sight including the laser coupled to the barrel end of the plug; after the student has aimed the firearm, activating a laser to illuminate a projected impact location of a projectile shot from the firearm as targeted by the student; and instructing the student to correct the aim of the firearm to illuminate the target via the activated laser, wherein the re-targeting process is configured to provide a feedback loop to the student for correcting the student's targeting skills independent of a triggering or firing of the target device.

12. The process according to claim 11 wherein via repetition of the process, the feedback loop is configured to provide a closed feedback loop for the student's brain to use in determining a correct point of stasis for the targeting device when the device is brought to bear on the target.

13. The process according to claim 12 wherein the repetition of the is configured to train a student to become reflexive in targeting through operant conditioning of proprioceptors linking a focal point to a shooting stance.

14. The process according to claim 13 wherein the process is configured to be independent of triggering such that while the targeting process becomes reflexive in nature, the triggering decision remains cognitive, instance specific action.

15. The process according to claim 11 wherein the operation of instructing the student to correct the aim of the targeting device further comprises instructing the student to freeze the firing position in a corrected point of stasis.

16. A process of training to target a targeting device, the process comprising: aiming a firearm equipped with the generally cylindrical training safety plug at a target without a laser being illuminated, wherein the generally cylindrical training/safety plug comprises: a generally cylindrical chamber end having a size adapted to fit within a chamber of a designated firearm, the chamber end having a cross-sectional dimension sufficient to prevent the chamber end from extending into a barrel of the designated firearm, the generally cylindrical chamber end further comprising a strike surface for receiving an impact of a firing pin of the designated firearm and a proximal end dimension such that the chamber end is not engaged by an ejector mechanism of the firearm; and a generally cylindrical shaft comprising a barrel end coupled to and extending distally from the generally cylindrical chamber end; the barrel end of the generally cylindrical shaft further adapted to extend through the barrel of the designated gun and extend beyond an end of the barrel, wherein the training/safety plug renders the designated firearm inert when the chamber end is disposed in a chamber of the firearm and the barrel end extends into the barrel of the firearm, the cross-sectional dimension of the chamber end prevents removal of the plug through the distal end of the barrel and removal of the plug requires the firearm to be disassembled to expose the chamber end of the barrel, wherein the cylindrical training/safety plug comprises a single piece of material, and a laser bore sight including the laser coupled to the barrel end of the plug; after aiming the firearm, activating the laser to illuminate a projected impact location of a projectile shot from the firearm as targeted by the student; and correcting the aim of the firearm to illuminate the target via the activated laser, wherein the re-targeting process is configured to provide a feedback loop to the student for correcting the student's targeting skills independent of a triggering or firing of the target device.

* * * * *